US007903997B2

(12) United States Patent
Jung et al.

(10) Patent No.: US 7,903,997 B2
(45) Date of Patent: Mar. 8, 2011

(54) COUPLING APPARATUS AND IMAGE FORMING APPARATUS EMPLOYING THE SAME

(75) Inventors: Woo-chul Jung, Youngin-si (KR); Jin-kyu Yang, Seongnam-si (KR); Sang-woon Lee, Seoul (KR); Eun-sang Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 734 days.

(21) Appl. No.: 11/947,313

(22) Filed: Nov. 29, 2007

(65) Prior Publication Data

US 2008/0134824 A1 Jun. 12, 2008

(30) Foreign Application Priority Data

Dec. 6, 2006 (KR) ..... 10-2006-0122948
Dec. 18, 2006 (KR) ..... 10-2006-0129578
Sep. 20, 2007 (KR) ..... 10-2007-0096135

(51) Int. Cl.
*G03G 15/00* (2006.01)

(52) U.S. Cl. ..... 399/107; 399/90; 399/110; 399/121; 49/324; 49/373; 49/371; 464/176

(58) Field of Classification Search ..... 74/63, 434, 74/567, 575, 519; 464/161, 162, 52, 170, 464/176; 49/324, 279, 373, 371, 379; 399/90, 399/107, 297, 302, 308, 124, 121, 110; 101/144; 403/322.1

See application file for complete search history.

(56) References Cited

U.S. PATENT DOCUMENTS

| | | | | |
|---|---|---|---|---|
| 7,386,252 | B2 * | 6/2008 | Portig et al. | 399/110 |
| 2002/0041775 | A1 * | 4/2002 | Ishii | 399/124 |
| 2006/0104662 | A1 | 5/2006 | Kawasumi | |
| 2006/0239716 | A1 | 10/2006 | Kim et al. | |

FOREIGN PATENT DOCUMENTS

| | | |
|---|---|---|
| JP | 9-114164 | 5/1997 |
| JP | 11-184279 | 7/1999 |
| JP | 2001-201953 | 7/2001 |
| JP | 2001-255750 | 9/2001 |
| JP | 2002-149037 | 5/2002 |
| JP | 2002202707 | * 7/2002 |
| JP | 2003-280489 | 10/2003 |
| JP | 2004-205871 | 7/2004 |
| KR | 1994-7506 | 10/1994 |
| KR | 20-0168094 | 2/2000 |
| KR | 2005-76126 | 7/2005 |

* cited by examiner

*Primary Examiner* — David P Porta
*Assistant Examiner* — Yara B Green
(74) *Attorney, Agent, or Firm* — Staas & Halsey LLP

(57) ABSTRACT

An image forming apparatus includes a main body unit which has an image forming unit; a door unit which couples with the main body unit to open and close the main body unit, and has a projection at one side thereof; a mid-transfer unit which couples with the door unit; a coupling knob which is provided in the main body unit and rotates in cooperation with pressure of the projection when the door unit is closed; and a coupling apparatus which is provided in the main body and transmits a driving force from the main body unit to the mid-transfer unit in cooperation with the rotation of the coupling knob.

17 Claims, 18 Drawing Sheets

COUPLING APPARATUS AND IMAGE FORMING APPARATUS EMPLOYING THE SAME

CROSS-REFERENCE TO RELATED APPLICATIONS

This application claims all benefits accruing under 35 U.S.C. §119 from Korean Patent Applications Nos. 10-2006-122948, 10-2006-129578 and 10-2007-0096135, filed on Dec. 6 and 18, 2006, and Sep. 20, 2007, respectively, in the Korean Intellectual Property Office the disclosures of which are incorporated herein by reference in their entireties.

BACKGROUND OF THE INVENTION

1. Field of the Invention

Aspects of the present invention relate to a coupling apparatus that performs a coupling function in cooperation with a rotation of a knob and an image forming apparatus employing the same and, more particularly, to a coupling apparatus installed in a small space to be automatically decoupled when a force applied to a knob is released and an image forming apparatus employing the same.

2. Related Art

Generally, an image forming apparatus driven by a motor is provided with a coupling apparatus between a power supply unit and a driving unit so that power can be automatically discontinued when a cover is opened while the power is on. FIGS. 1A and 1B are schematic views illustrating a coupling apparatus for a conventional image forming apparatus. In the coupling apparatus for a conventional image forming apparatus, a driving gear 25 and a driving power transmitting gear 35 are mutually engaged or disengaged in cooperation with an opening and closing operation of a front cover (not shown) of an image forming apparatus. The driving gear 25 is provided on a shaft 27 of a driving roller (not shown) that rotatably drives a transfer belt (not shown) to be driven lengthwise of the shaft 27 by an operation of a coupling lever 21 to be described later.

In order to perform the above-described coupling function, the conventional coupling apparatus includes a locking lever 15 rotatably provided in a frame 10, a coupling lever 21 rotated in cooperation with the locking lever 15, and a tensile spring 17 provided between the frame 10 and the locking lever 15. The locking lever 15 is rotated by an opening and closing operation of the front cover. If the front cover is closed, the locking lever 15 rotates from a position shown in FIG. 1A to a position shown in FIG. 1B. The tensile spring 17 pulls the locking lever 15 so as to locate the locking lever 15 in the position shown in FIG. 1A while the front cover is open. When the locking lever 15 rotates, the tensile spring 17 pulls the locking lever 15 to a direction to accelerate the rotation of the locking lever 15 at the moment when the rotating angle exceeds an elastic bias critical point. The locking lever 15 snaps to the position shown in FIG. 1B by the elastic force.

The coupling lever 21 is rotatably installed and centered around on the shaft 27 of the driving roller (not shown). The coupling level 21 rotates in cooperation with the rotation of the locking lever 15. A long hole 21*a* is formed in the coupling lever 21, and a guide projection 15*a* coupled to the long hole 21*a* is formed in the locking lever 15. When the locking lever 15 rotates, the guide projection 15*a* slides along the long hole 21*a* and guides the rotation of the coupling lever 21.

However, the coupling apparatus according to the above described configuration has several problems. First, an error by the user or an external impact while the front cover is open may cause the position of a driving gear and a power transmitting gear to change to the position shown in FIG. 1B (where the driving and power transmitting gears 25 and 35 are engaged with each other) by rotation of the locking lever 15 and an elastic force of the tensile spring. As such, the coupling structure may be damaged. If the user wants to close the front cover while in a coupled state by the snap operation of the locking lever 15, the front cover is not closed normally, and the front cover or the coupling structure may be damaged by an abnormal contact between the front cover and the coupling apparatus.

Second, since the locking lever 15 and the coupling lever 21 have a different center of rotation, the configuration can be complicated and takes up a large amount of space. Third, since the locking lever 15 and the coupling lever 21 are engaged in a sliding system, durability of the system is reduced. Since the front cover of the image forming apparatus is repeatedly opened and closed, and accordingly, a strong coupling structure is related to a color registration quality of the image forming apparatus, the sliding system wears out quickly and will need to be replaced often.

SUMMARY OF THE INVENTION

Aspects of the present invention provide a coupling apparatus that can be automatically decoupled if an external force does not adequately perform a coupling function by converting a rotational movement into an axial direction rectilinear movement, and at the same time, can make an entire configuration more compact and more durable by disposing the components on one axis. According to additional aspects of the present invention, an image forming apparatus employing the system described above is provided.

According to an aspect of the present invention, an image forming apparatus includes: a main body unit which has an image forming unit; a door unit which couples with the main body unit to open and close the main body unit, and has a projection at one side thereof; a mid-transfer unit which couples with the door unit; a coupling knob which is provided in the main body unit and rotates in cooperation with pressure of the projection when the door unit is closed; and a coupling apparatus which is provided in the main body and transmits a driving force from the main body unit to the mid-transfer unit in cooperation with the rotation of the coupling knob.

According to another aspect of the present invention, the coupling apparatus includes: a frame; and a shaft installed in the frame and arranged to rotate and move in an axial direction, wherein the shaft interlocks with the rotation of the coupling knob and moves to the mid-transfer unit in the axial direction.

According to another aspect of the present invention, the coupling apparatus includes: a coupling link coupled to the frame movably in the axial direction of the shaft and arranged to move in the axial direction in cooperation with the rotation of the coupling knob; and a coupling unit coupled to the shaft, and arranged to rotate along with the shaft and to move between a coupling position and a decoupling position in the axial direction of the shaft according to the movement of the coupling link.

According to another aspect of the present invention, the image forming apparatus further includes an elastic member to elastically bias the coupling unit to the decoupling position.

According to another aspect of the present invention, the coupling unit includes: a coupling member coupled to the shaft, rotatably installed independently of the coupling link, and coupled to the mid-transfer unit; and a relay member coupled to the shaft to transmit a driving force from a driving source to the shaft.

According to another aspect of the present invention, the elastic member is provided between the relay member and the coupling knob.

According to another aspect of the present invention, the shaft includes a first stopping part in which the coupling member is installed, the mid-transfer unit includes a mid-transfer belt and a driving roller to drive the mid-transfer belt, and the coupling member includes a first hook member hooked to the first stopping part and a spline formed on an inside circumference of the coupling member and engaged with a rotational shaft of the driving roller.

According to another aspect of the present invention, the frame includes: a frame main body having an installing hole in which the shaft, the coupling knob, and the coupling link are installed; a first installing part formed in the frame main body, and in which the coupling knob is rotatably installed; and a first guide part formed in the frame main body to guide the coupling link to move in the axial direction.

According to another aspect of the present invention, the coupling knob includes: a knob main body having a first through hole through which the shaft is installed; a first movement changing part formed on one side of the knob main body to change the rotational movement of the knob main body into the axial direction movement; a second installing part formed in a position of the knob main body so as to face the first installing part; and a knob member formed in the knob main body to rotate the knob main body.

According to another aspect of the present invention, the first installing part is provided as a guide hole formed around the installing part to guide the rotation of the coupling knob; and the second installing part is provided as a coupling protrusion projected in the knob main body and rotatably installed in the guide hole, to regulate the rotation of the knob main body.

According to another aspect of the present invention, the coupling link includes: a link main body having an accommodating part that accommodates the coupling member, and a second through hole through which the shaft is installed; a second movement changing part formed on one side of the link main body to face the first movement changing part to change the rotation of the first movement changing part into the axial direction movement; and a second guide part formed in a position of the link main body corresponding to the first guide part to guide the link main body to move in the axial direction.

According to another aspect of the present invention, the first guide part is provided as a guide projection protruding from one side of the frame main body, and the second guide part is provided as a guide groove in the link main body in a shape corresponding to a shape of the guide projection.

According to another aspect of the present invention, the image forming apparatus further includes a coupling lever coupled to the coupling knob and arranged to rotate along with the coupling knob, wherein the elastic member is coupled to the coupling lever to elastically bias the coupling lever in a direction of moving the coupling knob to the decoupling position when the coupling knob is released from the pressure of the projection.

According to another aspect of the present invention, the coupling link includes: a link main body having a through hole through which the shaft is installed; and a third movement changing part protruding from an external circumference of the link main body to change rotation of the coupling knob into an axial direction movement.

According to another aspect of the present invention, the coupling knob includes: a knob main body arranged to move in the axial direction of the shaft; a knob member extended from the knob main body outwardly and coupled to the coupling lever; and a second guide part that formed on one side of the knob main body and accommodating and releasing the third movement changing part in cooperation with rotation of the knob main body to guide the knob main body to move in the axial direction.

According to another aspect of the present invention, the coupling member includes: a gear part coupled to the shaft and transmitting a rotational force from a driving source to the shaft; and a coupling unit coupled to the mid-transfer unit at the coupling position and transmitting the rotational force from the gear part to the mid-transfer unit.

According to an aspect of the present invention, a coupling apparatus is provided. The coupling apparatus comprises a frame; a shaft installed in the frame and arranged to rotate in an axial direction; a coupling knob rotatably coupled to the frame and arranged to rotate coaxially with and independently of the shaft by an external force; a coupling link coupled to the frame movably in the axial direction of the shaft, and arranged to move in the axial direction according to the rotation of the coupling knob; a coupling unit coupled to the shaft arranged to rotate along with the shaft and to move between a coupling position and a decoupling position in the axial direction of the shaft according to the movement of the coupling link, to couple a component to a driving unit; and an elastic member installed around the shaft to elastically bias the coupling unit to the decoupling position.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1A:
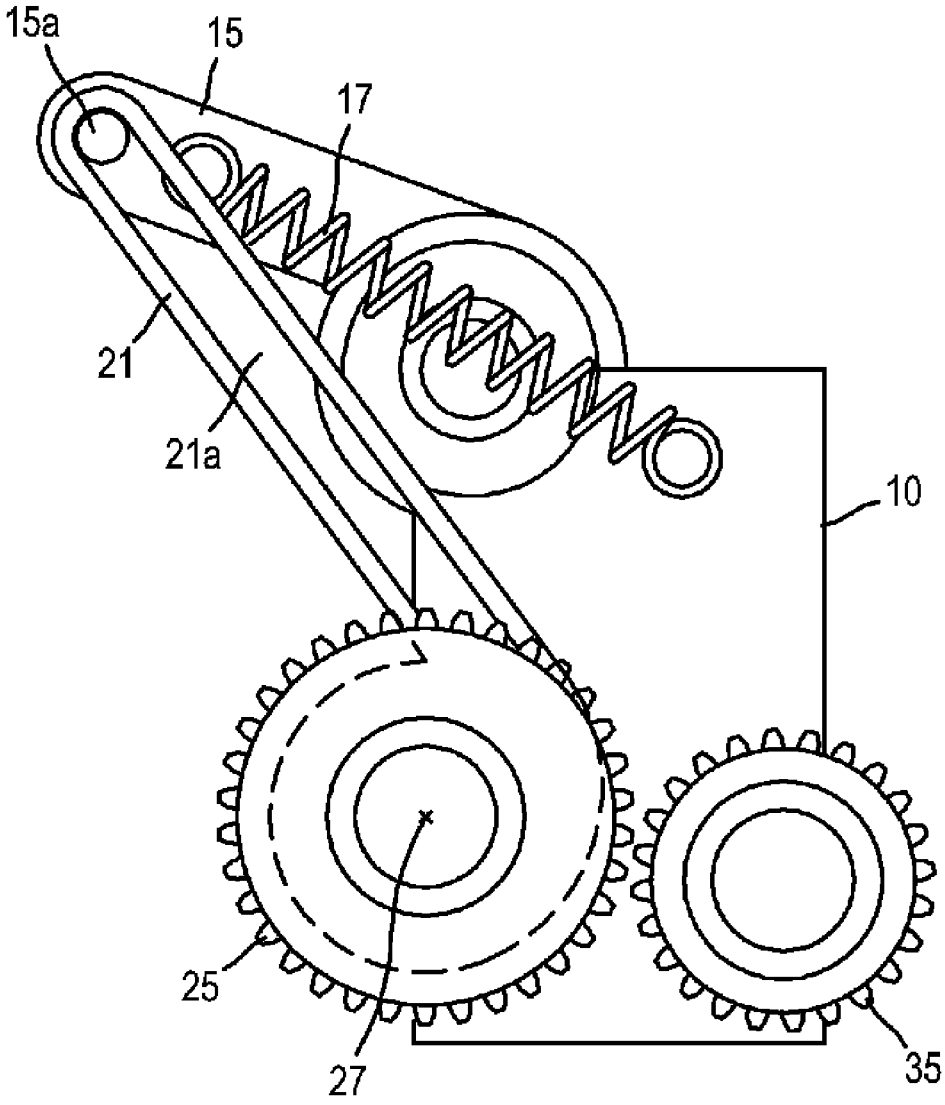
FIGS. 1A and 1B are schematic views illustrating a coupling apparatus for an image forming apparatus that has a configuration for transmitting power in cooperation with a conventional front cover.
Figure 1B:
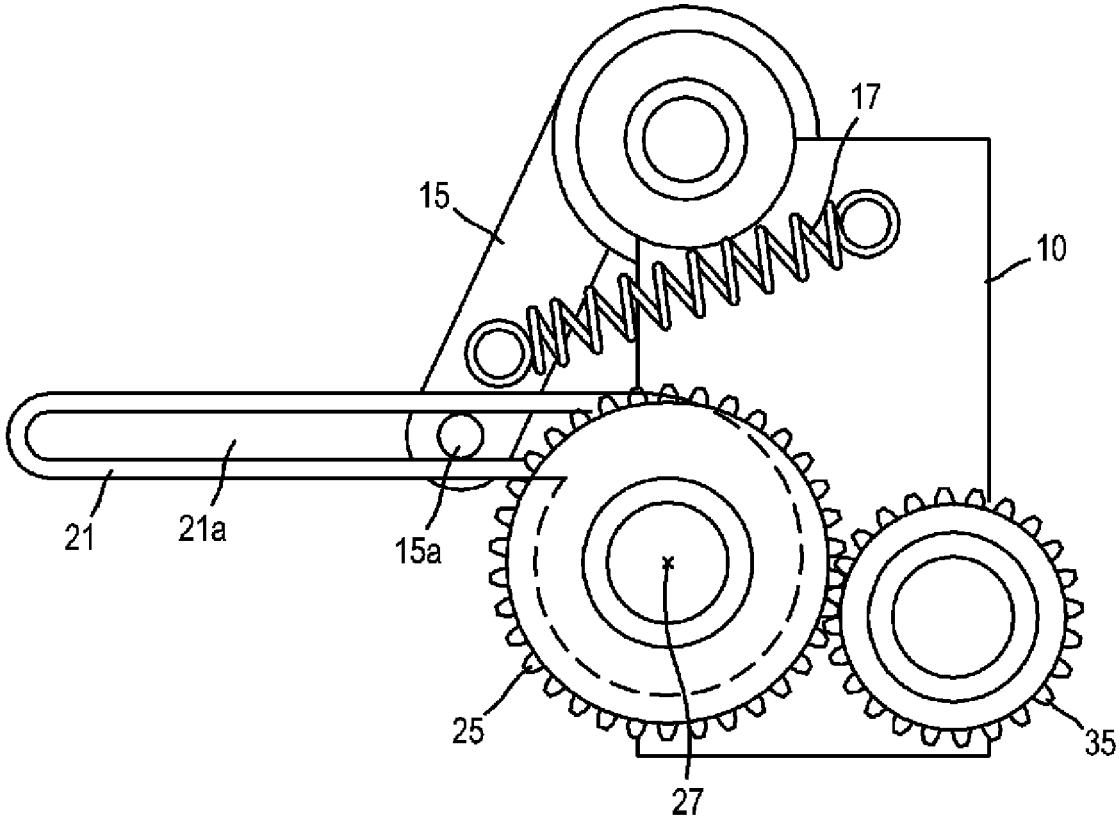

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 2:
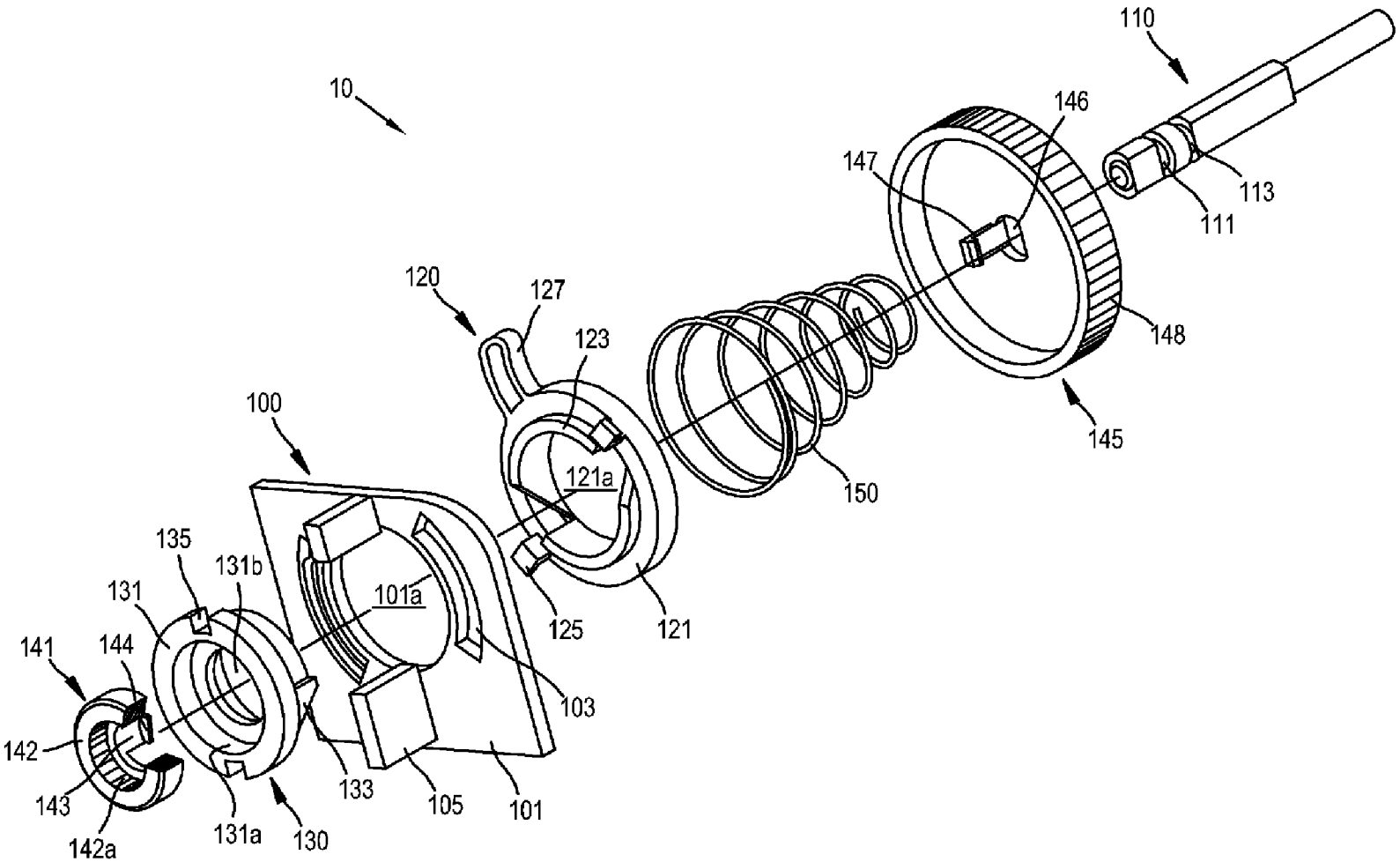
FIG. 2 is a separate perspective view illustrating a coupling apparatus according to a first example embodiment of the present invention.

FIG. 2 is a separate perspective view illustrating a coupling apparatus 10 according to a first example embodiment of the present invention. The coupling apparatus 10 includes a frame 100, a shaft 110 installed in the frame 100 to rotate and move in an axial direction, a coupling knob 120 rotatably coupled to the frame 100, a coupling link 130 coupled to the shaft 110 to move in the axial direction of the shaft 110, coupling units 141, 145 coupled to the shaft 110, and an elastic member 150.

The frame 100 includes a frame main body 101, a first installing part 103, and a first guide part 105. The first installing part 103 and the first guide part 105 are formed in the frame main body 101. The frame main body 101 includes an installing hole 101*a* through which the shaft 110, the coupling knob 120, and the coupling link 130 are at least partially installed. The first installing part 103 is formed around the first installing hole 101*a*. The coupling knob 120 is installed inside the first installing part 103 so as to rotate independently with respect to the rotation of the shaft 110.

The first guide part 105 guides a movement direction of the coupling link 130. If the coupling link 130 moves in cooperation with the rotation of the coupling knob 120, the first guide part 105 guides the coupling link 130 to move in the axial direction of the shaft 110. The first guide part 105 also regulates the rotation of the coupling link 130.

The coupling knob 120 is rotatably coupled to the first installing part 103 of the frame 100, and rotates independently from the shaft 110 by an external force. The coupling knob 120 has the same rotating center as that of the shaft 110. The shaft 110 and the coupling knob 120 rotate on the same shaft. As described above, if the coupling knob 120 and the shaft 110 are disposed on the same shaft, the frame 100 takes up a smaller volume, and the configuration of the coupling apparatus 10 is more compact.

The coupling knob 120 includes a knob main body 121 having a first through hole 121*a* through which the shaft 110 is formed, a first movement changing part 123 formed on one side of the knob main body 121, and a second installing part 125. The coupling knob 120 further includes a knob member 127 projected from the knob main body 121. The knob member 127, which comes into contact with a user's hand or a separate component, enables the knob main body 121 to rotate.

The first movement changing part 123 changes the rotational movement of the knob main body 121 into the axial movement. The first movement changing part 123 protrudes from a side of the knob main body 121 facing the coupling link 130, and has a slide cam configuration of a predetermined profile.

The second installing part 125 is formed in a predetermined position of the knob main body 121 facing the first installing part 103. The first and the second installing part 103 and 125 have complementary shapes. The second installing part 125 is rotatably coupled to the first installing part 103. The coupling knob 120 is rotatably coupled to the frame 100.

FIG. 2 shows an example of the first and the second installing parts 103 and 125. The first installing part 103 is provided as a guide long hole perforated around the installing hole 101*a*. The second installing part 125 may be provided as a coupling protrusion protruding from the knob main body 121 and rotatably coupled to the guide long hole. The coupling protrusion is provided as a hook to prevent the coupling knob 120 and the frame 100 from separating and to regulate the rotation of the knob main body 121 if the coupling protrusion is coupled to the guide long hole. However, the first and the second installing part 103 and 125 are not limited to the configuration shown in FIG. 2, but may be configured in various shapes. For example, the first installing part 103 may be formed as a coupling protrusion, the second installing part 103 may be formed as a guide long hole, etc.

The knob member 127 is formed in the knob main body 121 to rotate the knob main body 121. The knob member 127 is rotated by the user or by a pressing member 310 (shown in FIG. 3A) formed in a cover 300 (shown in FIG. 3A) to be described later.

The coupling link 130 is coupled to the frame 100 in the axial direction of the shaft 110. The coupling link 130 moves in the axial direction in cooperation with the rotation of the coupling knob 120. The coupling link 130 includes a link main body 131, a second movement changing part 133 formed on one side of the link main body 131, and a second guide part 135. An accommodating part 131*a* and a second through hole 131*b* are formed in the link main body 131.

The second movement changing part 133 changes the rotational movement of the first movement changing part 123 into movement in the axial direction. The second movement changing part 133 is formed on one side of the link main body 131 facing the first movement changing part 123. The second movement changing part 133 has a slide cam structure of a predetermined profile corresponding to the first movement changing part 123. The second guide part 135 is formed in a position of the link main body 131 corresponding to the first guide part 105, and guides the link main body 131 to move in the axial direction of the shaft 110.

FIG. 2 also shows an example of the first and the second guide parts 105 and 135. The first guide part 105 may be provided as a guide protrusion protruding from the frame main body 101. The second guide part 135 is provided as a shape corresponding to a shape of the guide protrusion and may be provided as a guide groove in the link main body 131. However, the first and the second guide parts 105 and 135 are not limited to the configuration shown in FIG. 2, but may be formed in various shapes. For example, the first installing part 103 may be formed as a coupling protrusion, the second installing part 103 may be formed as a guide long hole, etc.

The coupling unit 141, 145 is coupled to the shaft 110 so as to rotate with the shaft 110. The coupling unit 141, 145 also moves between a decoupling position (shown in FIGS. 3A and 3B) and a coupling position in an axial direction of the shaft 110 in cooperation with the movement of the coupling link 130. For this purpose, the coupling unit 141, 145 includes a coupling member 141 and a relay member 145.

Figure 3A:
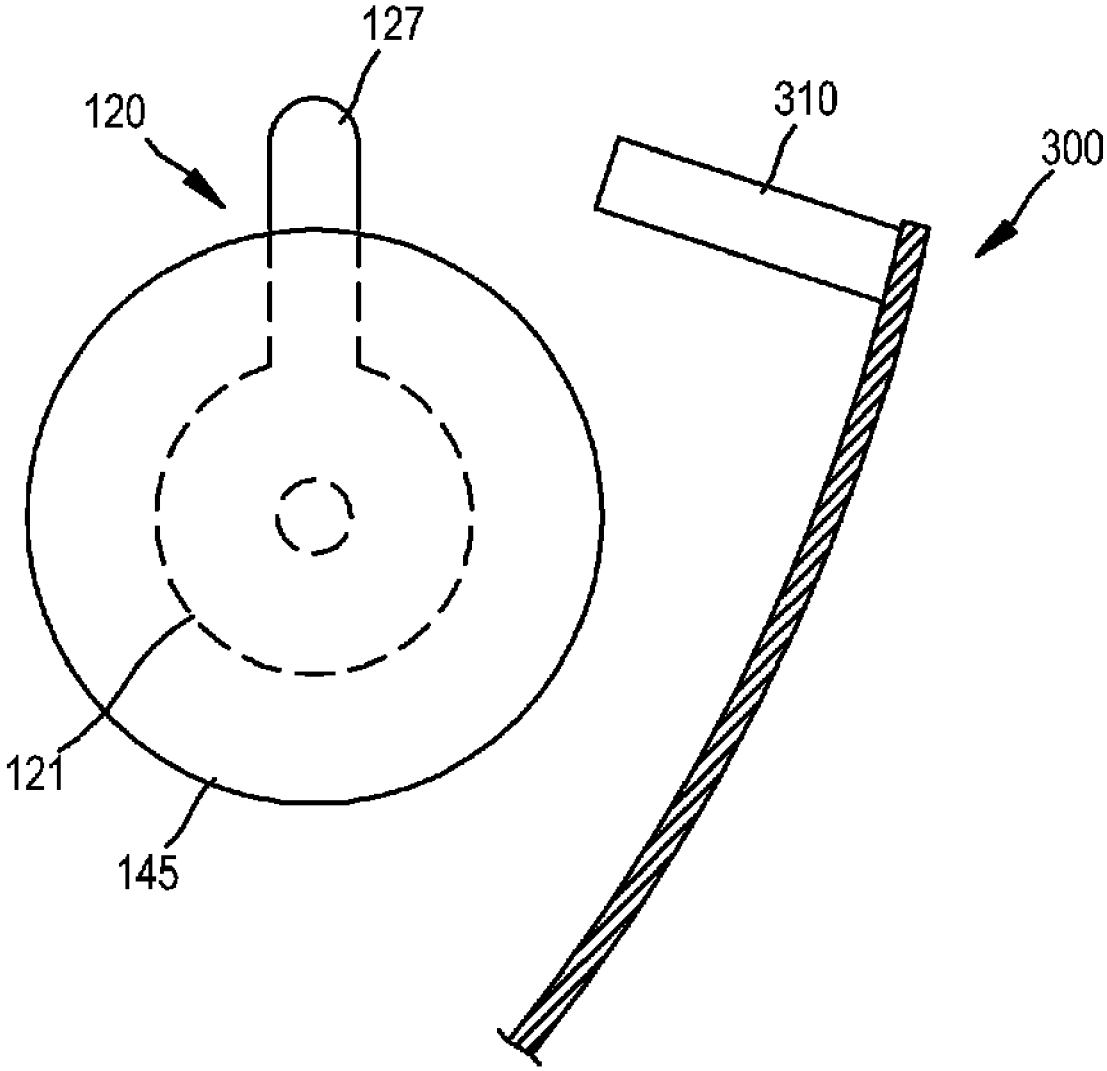
FIGS. 3A to 3C are schematic views illustrating an operating principle of the coupling apparatus according to the first example embodiment of the present invention when coupling is released.
Figure 3B:
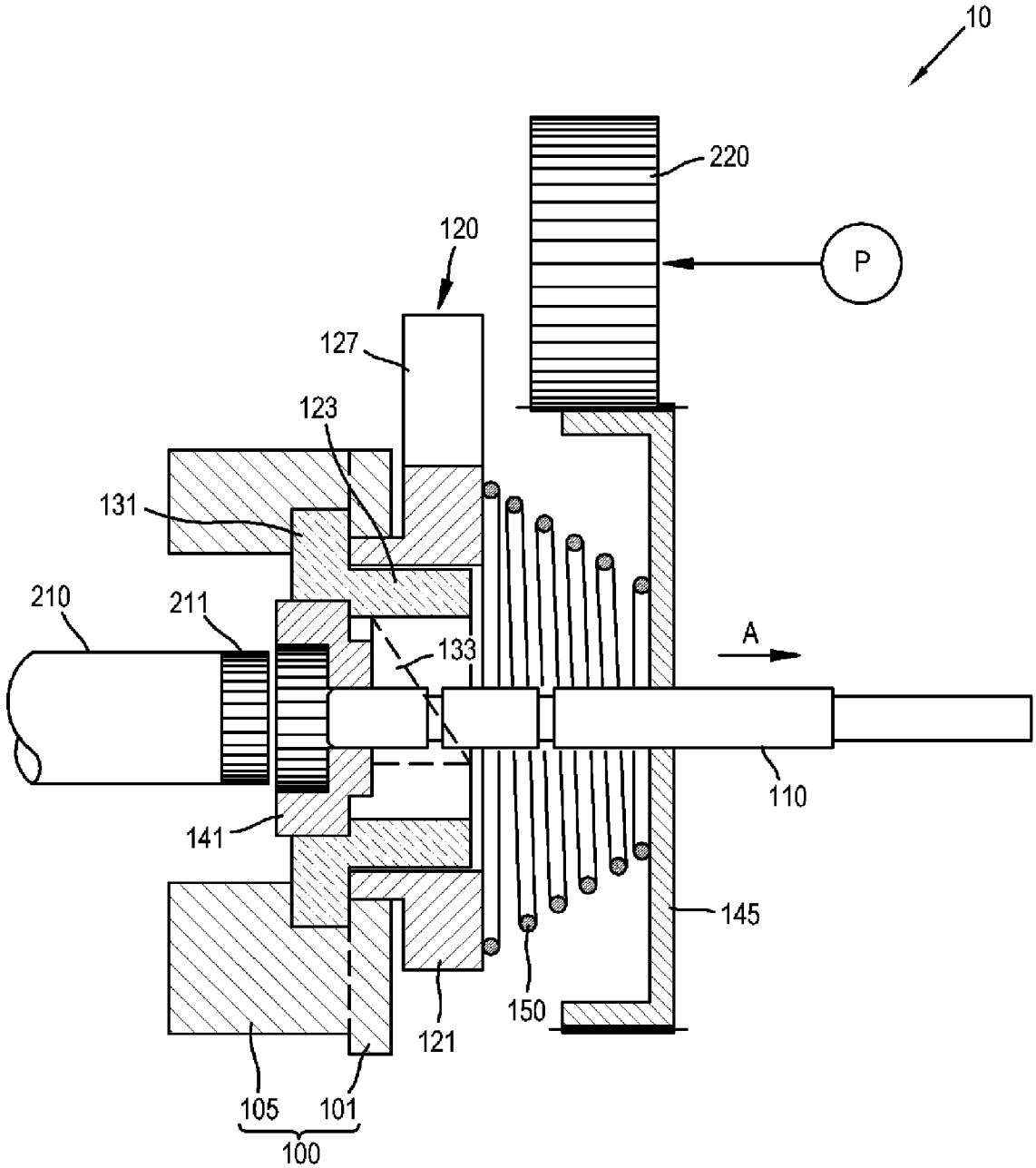

The coupling member 141 is installed in the accommodating part 131*a* to rotate independently, and is coupled to the first counterpart (see 210 in FIG. 3B). The coupling member 141 is grooved, and includes a coupling part 142 and a first coupling hole 143 coupled to the shaft 110. A spline is formed on the inside circumference 142*a* of the coupling part 142. An end part of the first counterpart 210 is formed with a spline on the external circumference 211 to selectively engage the first counterpart 210 with the coupling part 142 according to an operating mode. The first coupling hole 143 and the shaft 110 are provided in the shape of "D" to mutually correspond so as to rotate the coupling member 141 with the shaft 110. If the shaft 110 rotates, the coupling member 141 rotates in cooperation with the rotation of the shaft 110.

The coupling member 141 grooved in the shaft 110 may be arranged so as not to be separated from the shaft 110. For this purpose, a first stopping part 111 is formed in the shaft 110 and a first hook member 144 is provided in a predetermined position of the coupling member 141. The first hook member 144 is hooked to the first stopping part 111 to prevent the coupling member 141 and the shaft 110 from separating.

The relay member 145 is coupled to the shaft 110 and transmits a rotational force between the shaft 110 and a second counterpart 220 (shown in FIG. 3B). The second counterpart 220 may be provided as a driving gear rotatably driven in engagement with a driving part (P).

The relay member 145 rotates along with the shaft 110, and at the same time, moves in the axial direction of the shaft 110. A coupling relation between the relay member 145 and the second counterpart 220 is maintained. A gear part 148 formed on the external circumference of the relay member 145 engages with the second counterpart 220. The engaged state is maintained even if the relay member 145 has moved in the axial direction of the shaft 110 with respect to the second counterpart 220.

A second coupling hole 146 is formed in the relay member 145 and the shaft 110 has in a "D" shape corresponding to each other so that the relay member 145 can rotate with the shaft 110. When the relay member 145 rotates, the shaft 110 rotates in cooperation with the rotation of the relay member 145. The relay member 145 grooved in the shaft 110 may be provided so as not to be separated from the shaft 110. For this purpose, a second stopping part 113 is formed in the shaft 110. A second hook member 147 is provided in a corresponding predetermined position of the relay member 145. The second hook member 147 is hooked to the second stopping part 113 to prevent the relay member 145 and the shaft 110 from separating.

The elastic member 150 elastically biases the coupling unit 141, 145 toward the decoupling position if the external force applied to the coupling knob 120 is released. The elastic member 150 automatically releases the coupling if the external force does not successfully convert the rotation of the coupling knob 120 into the axial direction movement to perform the coupling function. The elastic member 150 is provided between the coupling knob 120 and the relay member 145. The elastic member 150 may be provided as a compressed spring that elastically biases the coupling unit 141, 145 in a decoupling direction. However, the elastic member 150 is not limited to the above-described compressed spring, but may be provided as a spring, such as a tensile spring or a torsion spring, or may be provided as an elastic material such as rubber.

Figure 3C:
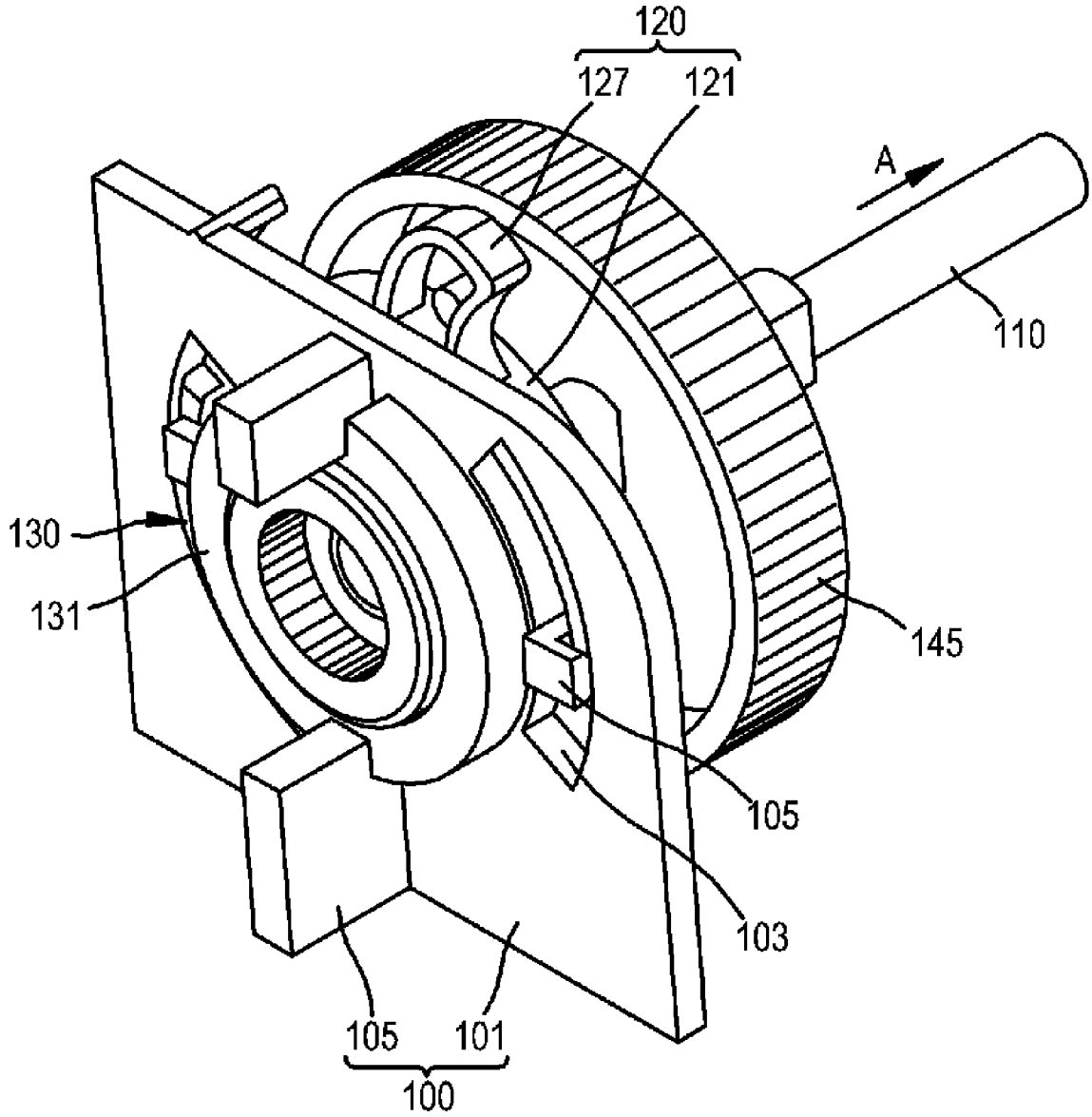
Figure 4A:
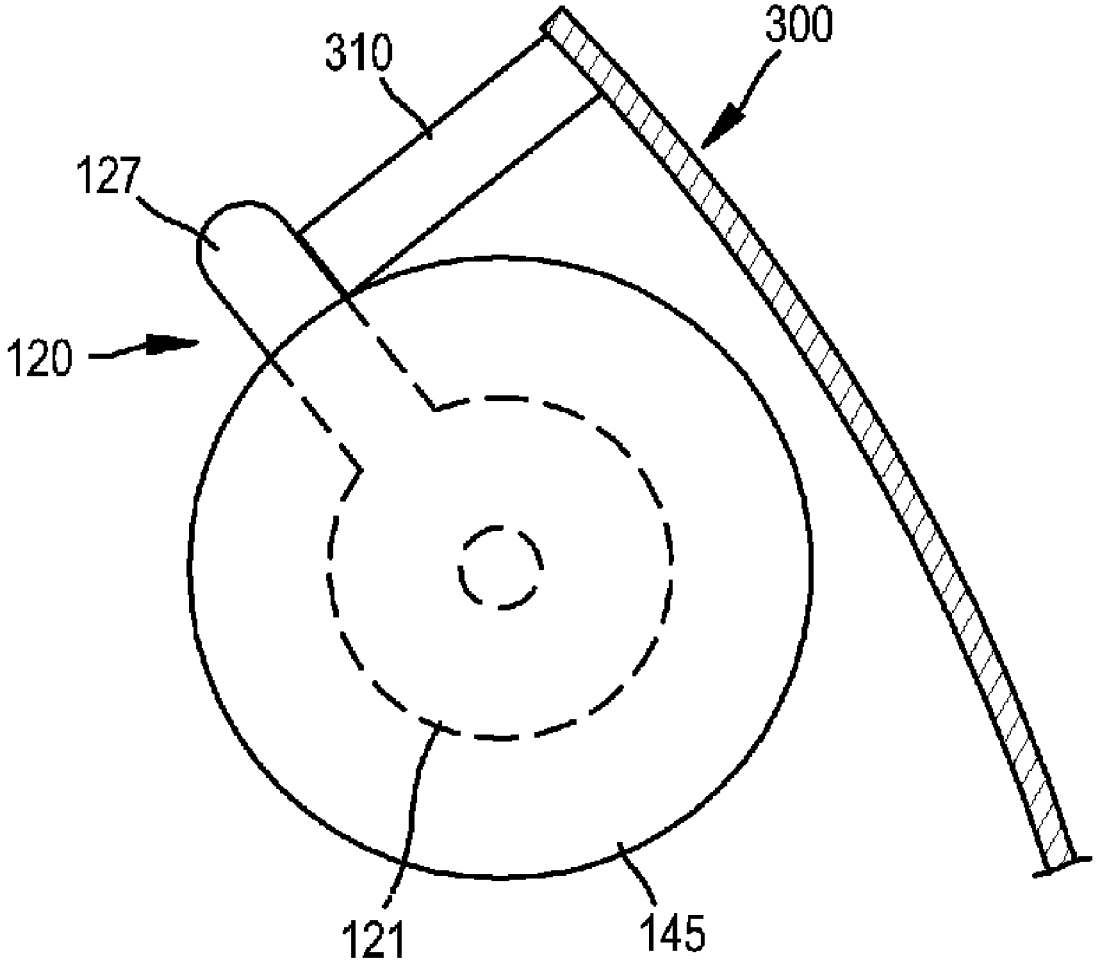
FIGS. 4A to 4C are schematic views illustrating an operating principle of the coupling apparatus according to the first example embodiment of the present invention when coupling is performed.
Figure 4B:
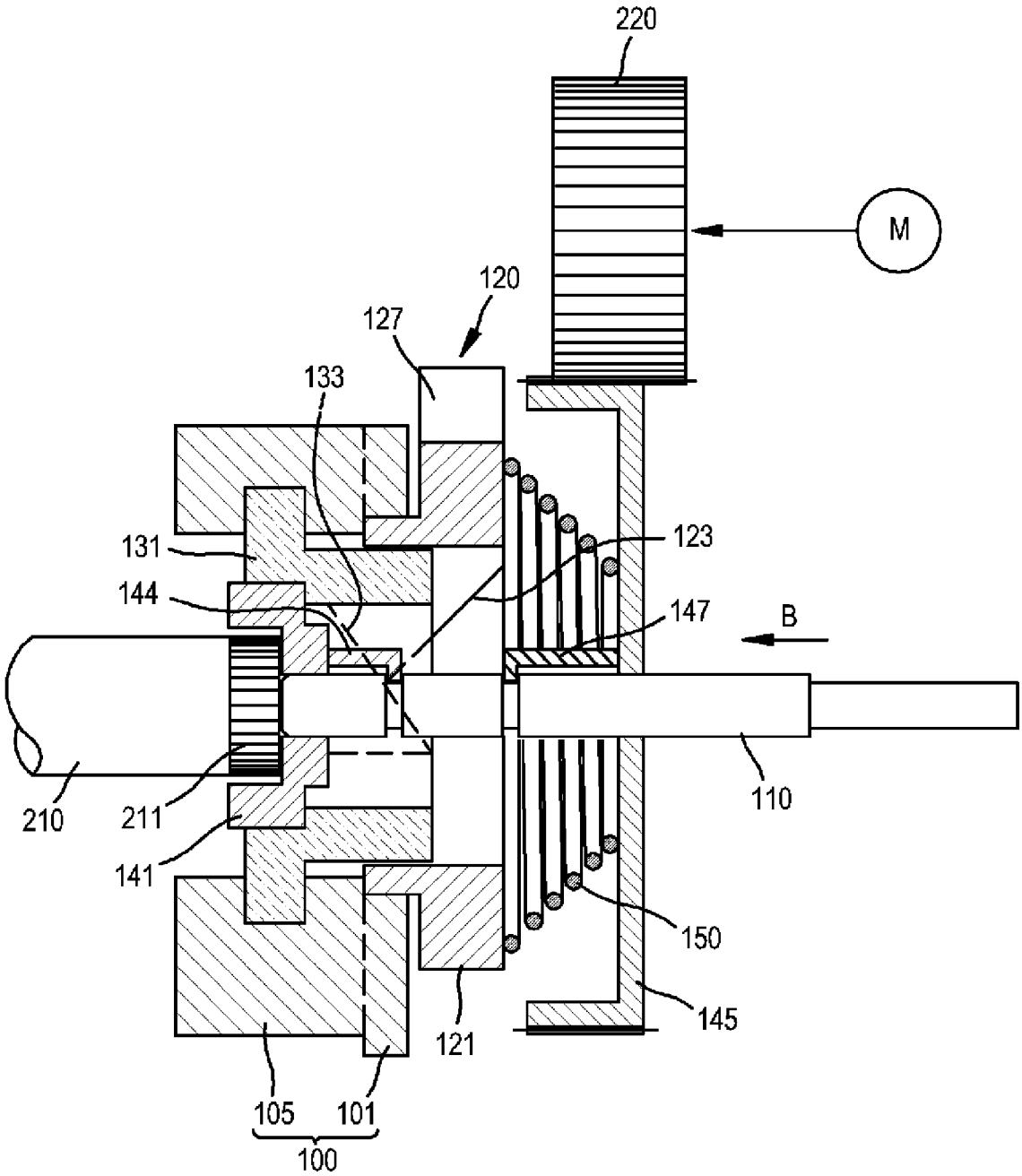
Figure 4C:
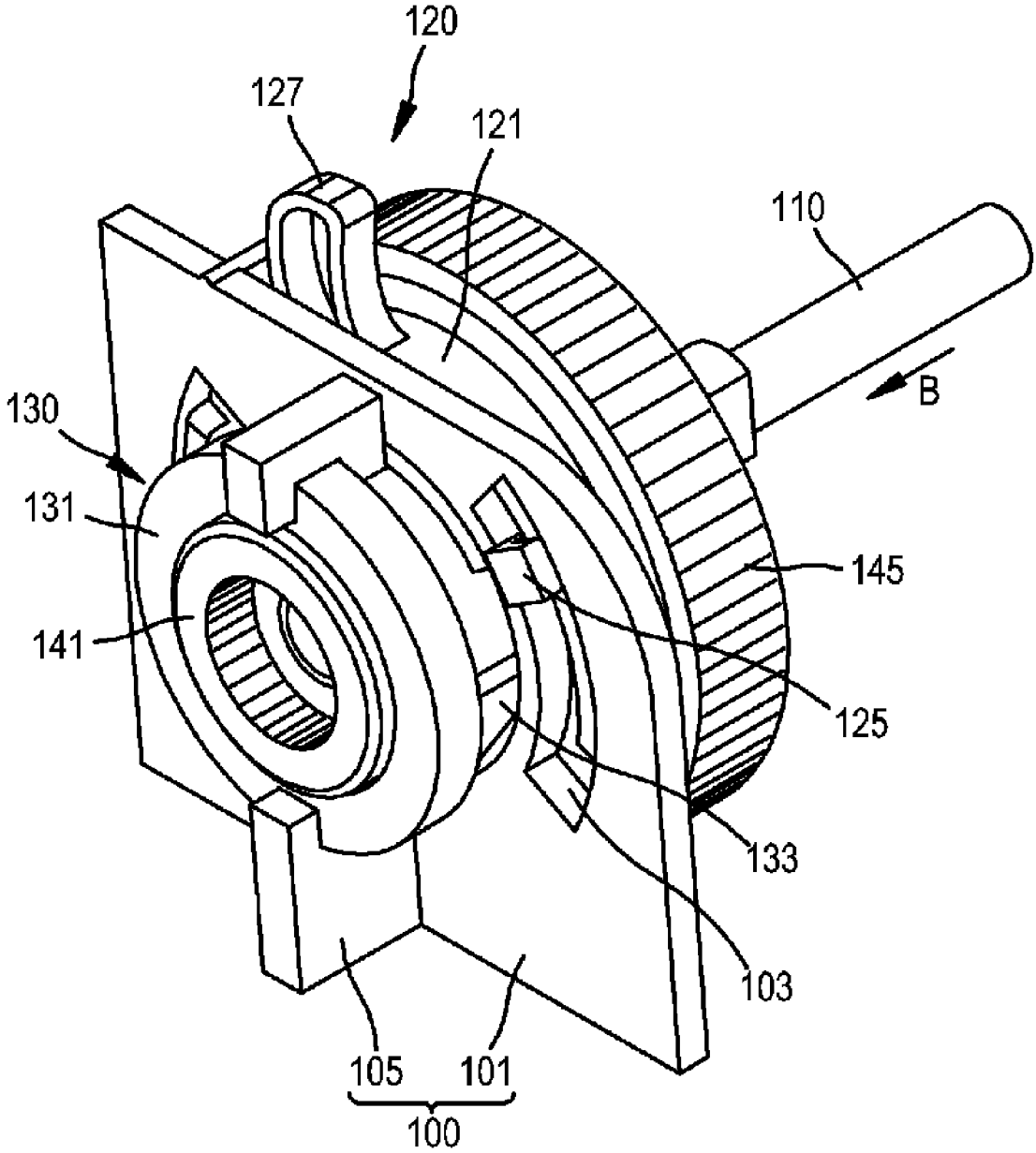

An operation of the coupling apparatus 10 according to the first example embodiment of the present invention will be described with reference to FIGS. 3A to 4C. FIGS. 3A to 3C are schematic views illustrating an operating principle of the coupling apparatus 10 according to the first example embodiment of the present invention in a decoupled state. FIGS. 4A to 4C are schematic views illustrating an operating principle of the coupling apparatus 10 according to the first example embodiment of the present invention in a coupled state.

Referring to FIG. 3A, when the coupling apparatus 10 is in a decoupled state, the knob member 127 is in a free state. While in the free state, the knob member 127 is not in contact with the pressing member 310 formed in the cover 300 or with the user's hand. As shown in FIGS. 3B and 3C, the relay member 145 is elastically biased in a direction receding from the coupling knob 120 (an arrow A) by elasticity of the elastic member 150. The coupling link 130 and the coupling member 141 are positioned so as to correspond to the cam profile between the first and the second movement changing parts 123 and 133. Accordingly, the spline engagement is released between the first counterpart 210 and the coupling member 141. As a result, the coupling member 141 rotates with the shaft 110 by the rotational movement of the second counterpart 220 rotatably driven by the driving part M, but the rotational force is not transmitted to the first counterpart 210. The coupling is automatically released by the elastic bias of the elastic member 150 when the knob member 127 is restored to a state without the external force.

As shown in FIG. 4A, the coupling knob 120 rotates by the external force applied to the knob member 127 in the coupled state. The knob member 127 may rotate by contacting with the projection member 310 formed in the cover 300. The cam profile provided between the first movement changing part 123 and the second movement changing part 133 is mismatched, and accordingly, the rotational movement of the coupling knob 120 changes to a rectilinear movement of the coupling link 130. The coupling link 130 moves linearly. The rotational state of the coupling link 130 is regulated by the first guide part 105.

The coupling member 141 accommodated in the accommodating part 131*a* of the coupling link 130 and the shaft 110 and the relay member 145 move in the axial direction (an arrow B direction) in which the elasticity of the elastic member 150 increases. While in the coupled state, the spline of the coupling member 141 and the spline of the first counterpart 210 are engaged, and the rotational force supplied from the driving part M is transmitted to the first counterpart 210 through the second counterpart 220, the relay member 145, the shaft 110 and the coupling member 141. The first counterpart 210 is rotatably driven by the transmitted rotational force.

If the force to the knob member 127 is released, for example, if the cover 300 is opened, the components are repositioned by the elastic bias of the elastic member 150 to the position shown in FIGS. 3A to 3C. Accordingly, the spline-engagement between the first counterpart 210 and the coupling member 141 is released.

Figure 5:
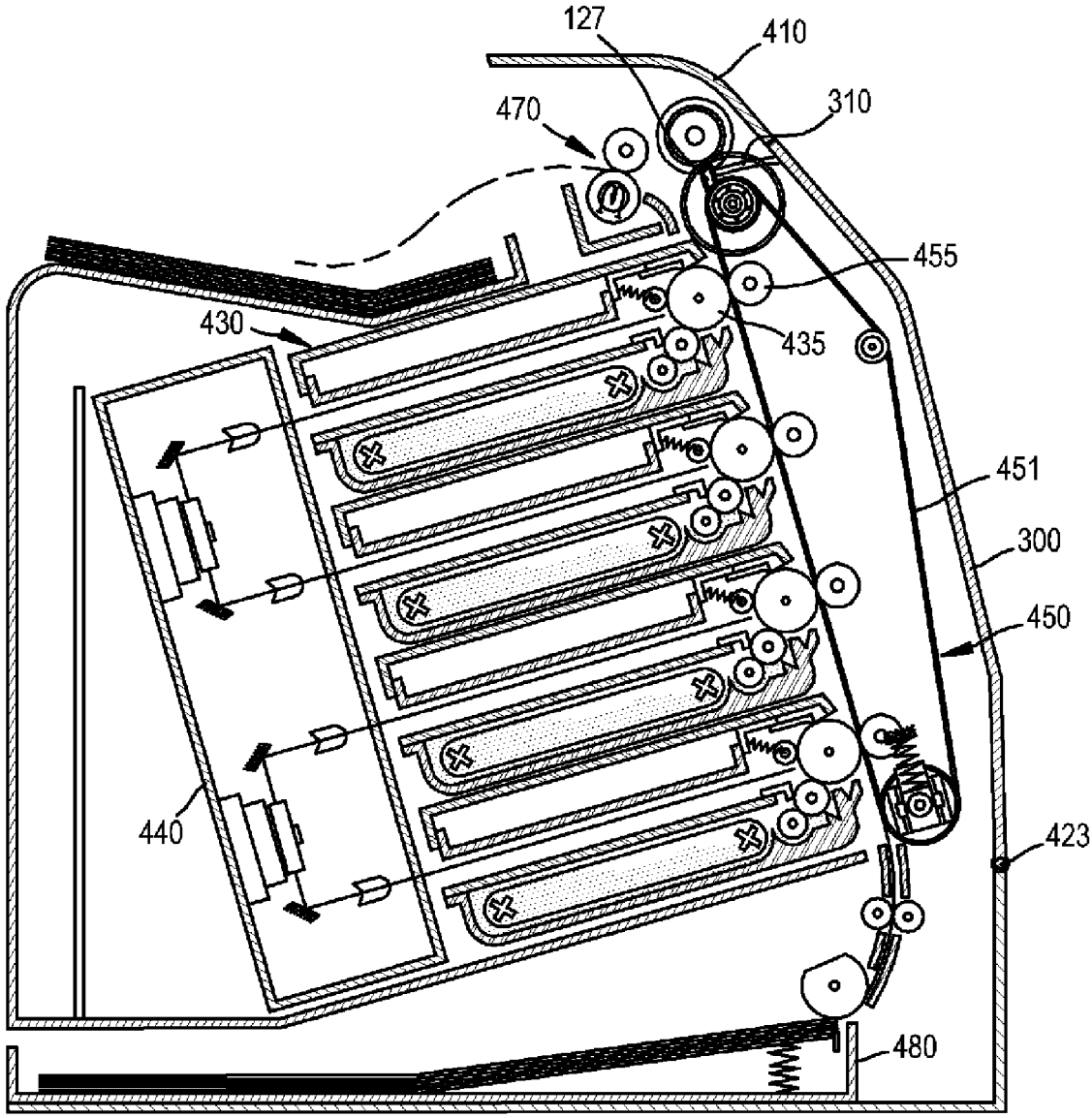
FIG. 5 is a schematically sectional view illustrating an image forming apparatus according to the first example embodiment of the present invention.
Figure 6:
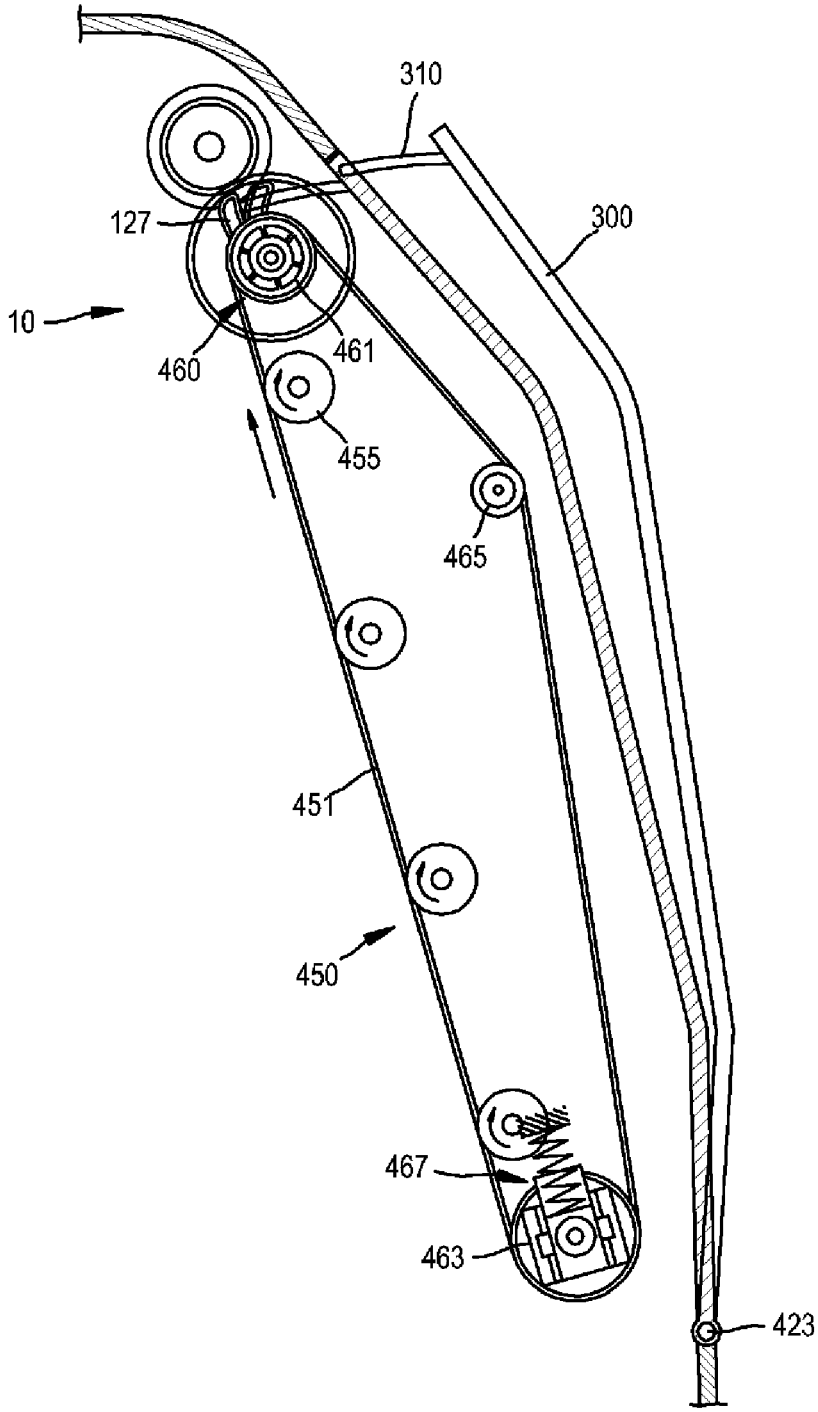
FIG. 6 is a schematically sectional view illustrating a transfer unit and the coupling apparatus of the image forming apparatus according to the first example embodiment of the present invention.
Figure 7:
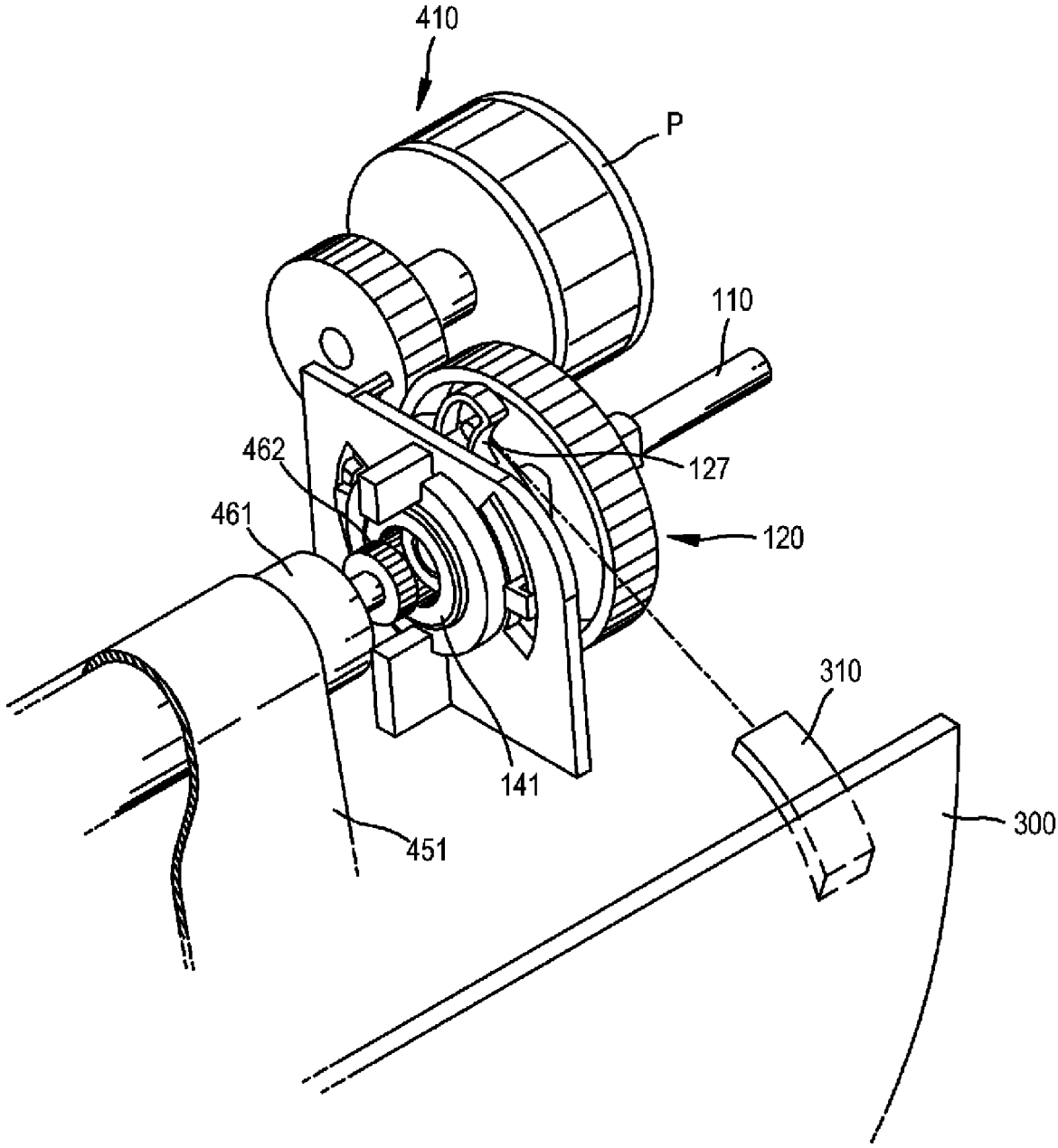
FIG. 7 is a schematically perspective view illustrating a main part of the transfer unit and the coupling apparatus of the image forming apparatus according to the first example embodiment of the present invention.

FIG. 5 is a schematic sectional view illustrating the image forming apparatus employing the coupling apparatus according to the first example embodiment of the present invention. FIG. 6 is a schematic sectional view illustrating a transfer unit and a coupling apparatus of the image forming apparatus according to the first example embodiment of the present invention. FIG. 7 is a schematic perspective view illustrating a main part of a transfer unit and a coupling apparatus of an image forming apparatus according to the first example embodiment of the present invention.

Referring to FIGS. 5 to 7, the image forming apparatus according to the first example embodiment of the present invention includes a cabinet 410, the cover 300, an image forming unit 430, 440, a transfer unit 450, a fusing unit 470, a driving unit P, and the coupling apparatus 10. The cover 300 is coupled to the cabinet 410 to be opened or closed. The image forming unit 430, 440 is provided inside the cabinet 410 and develops a toner to form an image. The transfer unit 450 transfers the image formed in the image forming unit 430, 440 onto a printable medium M. The driving unit P and the coupling apparatus 10 are provided inside the cabinet 410. The fusing unit 470 fuses the image transferred onto the printable medium M through the transfer unit 450.

The cabinet 410 forms an external appearance of the image forming apparatus. A supplying unit 480 is detachably provided in the cabinet 410 to store a printable medium M to be supplied to the image forming apparatus. The printable medium M supplied through the supplying unit 480 is fed between the image forming unit 430, 440 and the transfer unit 450 through a feeding path.

The cover 300 is coupled to the cabinet 410 by a hinge 423 and is rotatably installed with respect to the hinge 423. The transfer unit 450 can be replaced with the image forming unit 430, 440 by opening and closing the cover 300. The cover 300 includes the pressing member 321 that is selectively contacted to the coupling apparatus 10 to perform the coupling function. The pressing member 310 is protruded in the inside of the cabinet 410 and is selectively contacted to the coupling knob 120 of the coupling apparatus 10.

The coupling apparatus 10 transmits the power supplied from the driving unit P to the transfer unit 450 by the external force applied to the pressing member 310 when the cover 300 is closed. When the cover 300 opens, the coupling apparatus 10 blocks power transmission by separating the pressing member 310 from the coupling apparatus 10.

The image forming unit 430, 440 includes a developing unit 431 and a light scanning unit 435. The developing unit 431 includes a photosensitive body 433 that responds to a light beam scanned from the light scanning unit 440 to form an electrostatic latent image. The developing unit 431 develops the toner onto the photosensitive body 435, to form a toner image on the photosensitive body 435. The developing unit 431 may be provided in plural numbers according to each of colors so as to form full color image in a single-pass type. FIG. 5 illustrates an example made of four units so as to realize yellow (Y), magenta (M), cyan (C), and black (B).

The light scanning unit 435 scans the light beam onto each of the plural photosensitive bodies 433 to form an electrostatic latent image thereon. For this purpose, the light scanning unit 440 has a multi-beam light scanning configuration to scan the light beam onto the plural photosensitive bodies 433 at the same time. The light scanning unit 435 includes a light part (not shown), a beam deflecting unit 437 that deflects the beam emitted from the light part, and an f-θ lens 439. The light part may be configured to have a plurality of radiating points or may be configured to provide a semi-conductive element having a single radiating point for each of the colors.

The transfer unit 450 is disposed to face the photosensitive bodies 435 across the printable medium M fed through the feeding path. The transfer unit 450 transfers the toner image formed in the photosensitive bodies 435 onto the supplied printable medium M. To perform the transfer function, the transfer unit 450 includes a transfer belt 451, a transfer roller 455, and a belt driving unit 460 (shown in FIG. 6). The transfer belt 451 and the transfer roller 455 are disposed to face the plurality of photosensitive bodies 435. The belt driving unit 460 rotatably drives the transfer belt 451.

The belt driving unit 460 includes a plurality of rollers 461, 463, and 465 that rotatably support the transfer belt 451 and a belt tension applying unit 467 that applies tension to the transfer belt 451 when the belt is normally driven and releases the tension applied to the transfer belt 451 in an initial stage. The plurality of rollers include a driving roller 461 that rotatably drives the transfer belt 451 and a tension roller 463 that applies tension to the transfer belt 451. The transfer belt 451 is driven by the rotational driving of the driving roller 461. The rotational force transmitted to the driving roller 461 is supplied from the driving unit 500 through the coupling apparatus 10.

The driving roller 461 corresponds to the above-described first counterpart 210. A spline part 462 (shown in FIG. 7) selectively coupled to the coupling apparatus 10 is installed in the end part of the driving roller 461. The driving roller 461 is selectively coupled to the coupling member 141 of the coupling apparatus 10 in engagement with the opening and closing operation of the cover 300 to be rotatably driven or not to be rotatably driven.

Turning to FIG. 7, a rotational shaft 461 a of the driving roller 461 may be installed coaxially with the shaft 110 of the coupling apparatus 10. In this way, the driving roller 461 and the coupling apparatus 10 are disposed on the same axis, the rotational components that constitute the coupling apparatus 10 can rotate centering on the shaft 523, and power transmitting components can be disposed in a small space, thereby improving space efficiency and enhancing durability.

Figure 8:
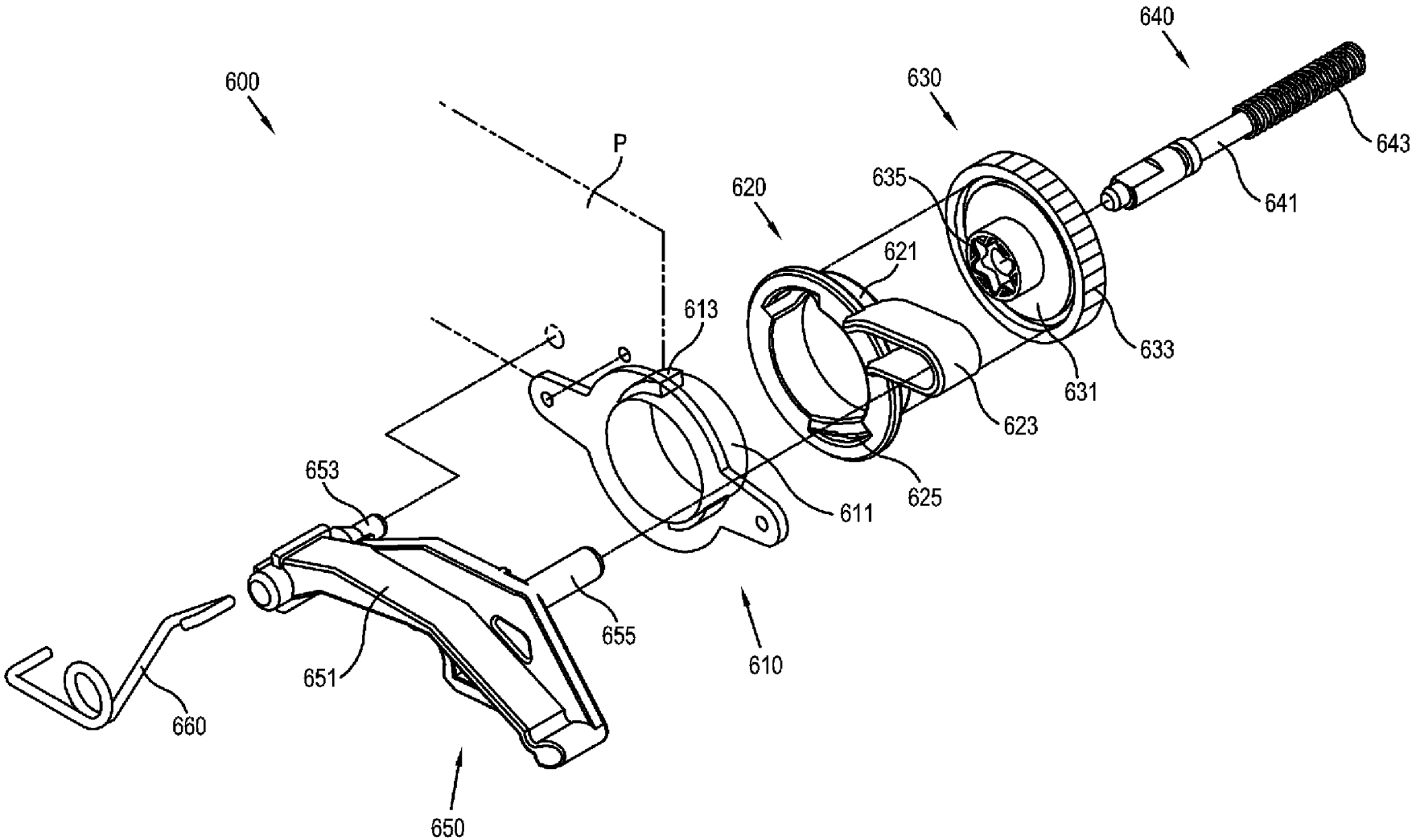
FIG. 8 is an exploded perspective view of a coupling apparatus according to a second example embodiment of the present invention.

FIG. 8 is an exploded perspective view of a coupling apparatus 600 according to a second example embodiment of the present invention. The coupling apparatus 600 includes a coupling link 610 fastened to a frame P; a shaft 640 installed in the coupling link 610 and to rotate and move in an axial direction; a coupling lever 650 provided to be rotated by an external force; a coupling member 630 coupled to the shaft 640, transmitting a rotational force from a second counterpart 220 (see FIG. 3B) to the shaft 640, and coupled to a first counterpart 211 (see FIG. 3B); a coupling knob 620 moving in cooperation with the rotation of the coupling lever 650 between a coupling position where the coupling member 630 is coupled to the first counterpart 211 and a decoupling position where the coupling member 630 moves from the coupling position in the axial direction of the shaft 640; and an elastic member 660 elastically biasing the coupling lever 650 in a direction of moving the coupling knob 620 toward the decoupling position.

The coupling link 610 is coupled to the frame P as shown in FIG. 8, and guides the coupling knob 620 to move in the axial direction according to the rotation of the coupling lever 650. The coupling link 610 includes a link main body 611 coupled to the frame P, and a third movement changing part 613 protruding from an external circumferential surface of the link main body 611 and guiding a second guide part 625 of the coupling lever 650.

The coupling knob 620 is coupled to the coupling lever 650 and moves along the axial direction of the shaft 640 in cooperation with the rotation of the coupling lever 650. The coupling knob 620 includes a knob main body 621 formed with a through hole to accommodate the link main body 611 of the coupling link 610, a knob member 623 extended from the knob main body 621 and accommodated in a knob coupling rib 655 of the coupling lever 650, and the second guide part 625 accommodating the third movement changing part 613 when the knob main body 621 rotates and guiding the knob main body 621 to the coupling position.

Figure 11A:
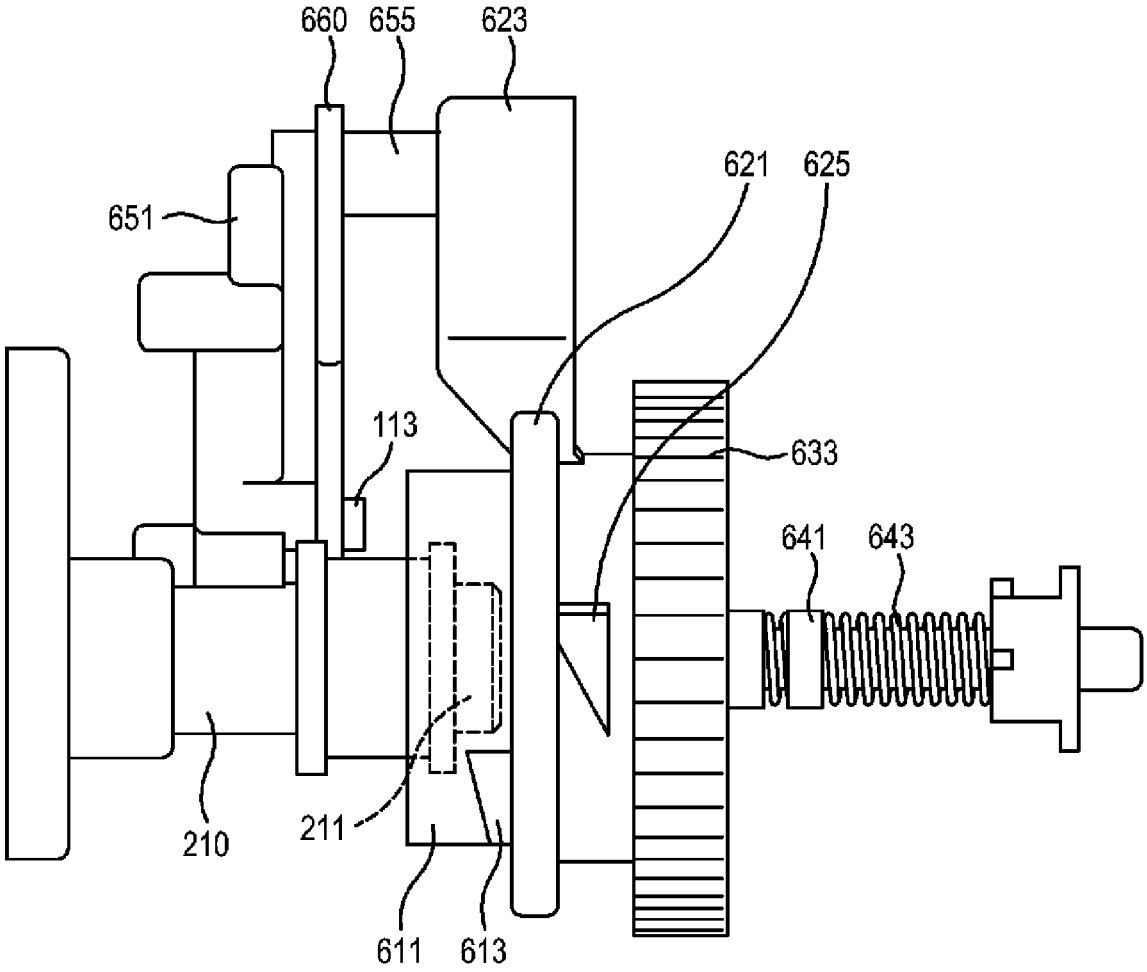
FIGS. 11A and 11B are sectional views illustrating the coupling apparatus according to the second example embodiment of the present invention.
Figure 11B:
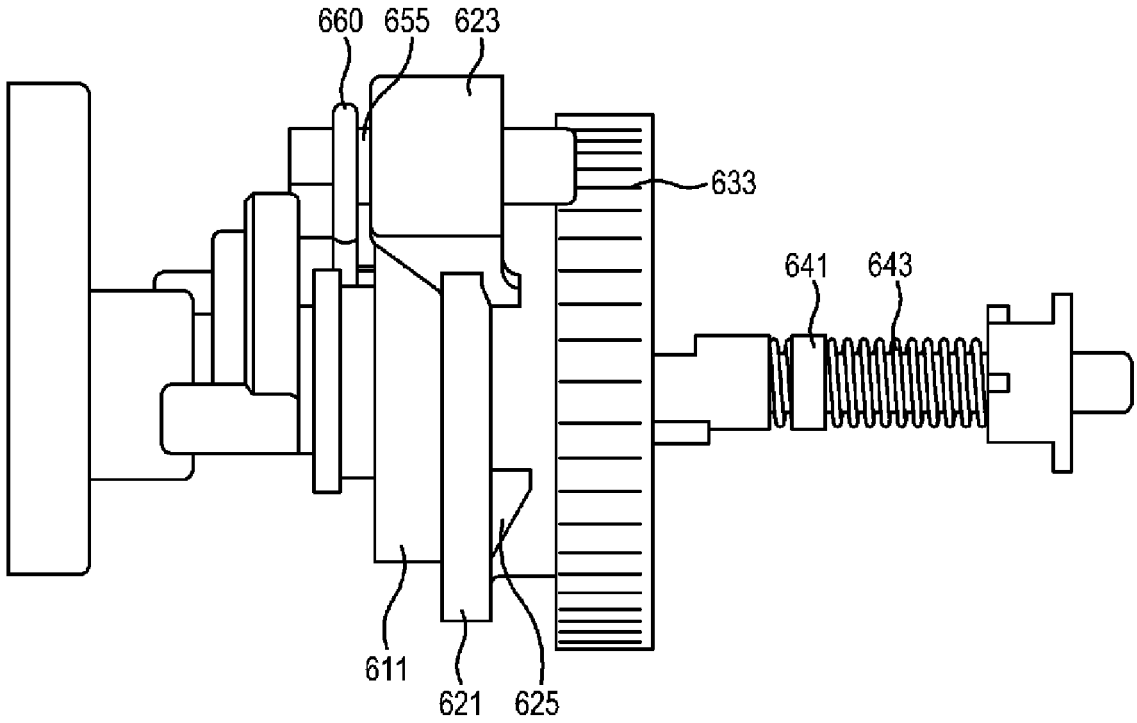

The knob main body 621 is larger than an outer diameter of the link main body 611 by a predetermined gap, and rotates across the knob main body 621 when the coupling lever 650 rotates. As shown in FIG. 11A, when the coupling lever 650 is not rotated, the second guide part 625 and the coupling lever 650 are positioned alternately with each other, so that the second guide part 625 does not accommodate the third movement changing part 613. On the other hand, as shown in FIG. 11B, when the coupling lever 650 is rotated, the second guide part 625 accommodates the third movement changing part 613 as the knob main body 621 rotates. Accordingly, the knob main body 621 moves to the coupling position in the axial direction along the third movement changing part 613.

The coupling member 630 moves together with the coupling knob 620 when the coupling knob 620 moves in the axial direction, and transmits the rotation of the second counterpart 410 to the first counterpart 211. In other words, the coupling member 630 is coupled to the first counterpart 211 when the coupling knob 620 is placed in the coupling position, and transmits the rotational force of the second counterpart 410 (refer to FIG. 7) to the first counter part 211.

The coupling member 630 includes a coupling member main body 631 rotatably coupled to the shaft 640, a gear part 633 formed on an external circumference of the coupling member main body 631 and receiving the rotational force from the second counterpart 410, and a coupling part 635 accommodating the shaft 640 and engaged with the first counterpart 211. Here, the coupling part 635 may be threaded on an inner surface thereof to be engaged with the first counterpart 211.

The shaft 640 is coupled with the coupling link 610, the coupling knob 620 and the coupling member 630, and transmits the rotational force of the second counterpart 410 to the first counterpart 211. The shaft 640 may have a cutting portion or a D-shaped cross-section so that the shaft 640 and the coupling member 630 are not separated while rotating.

Meanwhile, an additional elastic member 643 may be provided for elastically biasing the shaft 640 and the coupling member 630 toward the coupling position.

The coupling lever 650 is rotatably coupled to the frame P and rotates by an external force (refer to '310' in FIG. 9A), thereby moving the coupling knob 620 to the coupling position. The coupling lever 650 includes a lever main body 651 to be pressed by the external force, the knob coupling rib 655 extended from the lever main body 651 and coupling with the coupling knob 620, and a hinge 653 coupled to the frame P.

The knob coupling rib 655 is accommodated in the knob member 623 and guides the coupling member 630 when the knob main body 621 moves between the coupling position and the decoupling position.

The elastic member 660 elastically urges the coupling lever 650 in such a manner that the coupling knob 620 and the coupling member 630 moves toward the decoupling position. The elastic member 660 has a first end coupled to the hinge 653 of the coupling lever 650 and a second end coupled to the knob coupling rib 655, thereby applying elasticity in the decoupling direction as shown in FIG. 9B.

With this configuration, operations of the coupling apparatus 600 according to the second example embodiment of the present invention will be described with reference to FIGS. 9A through 11B.

Figure 9A:
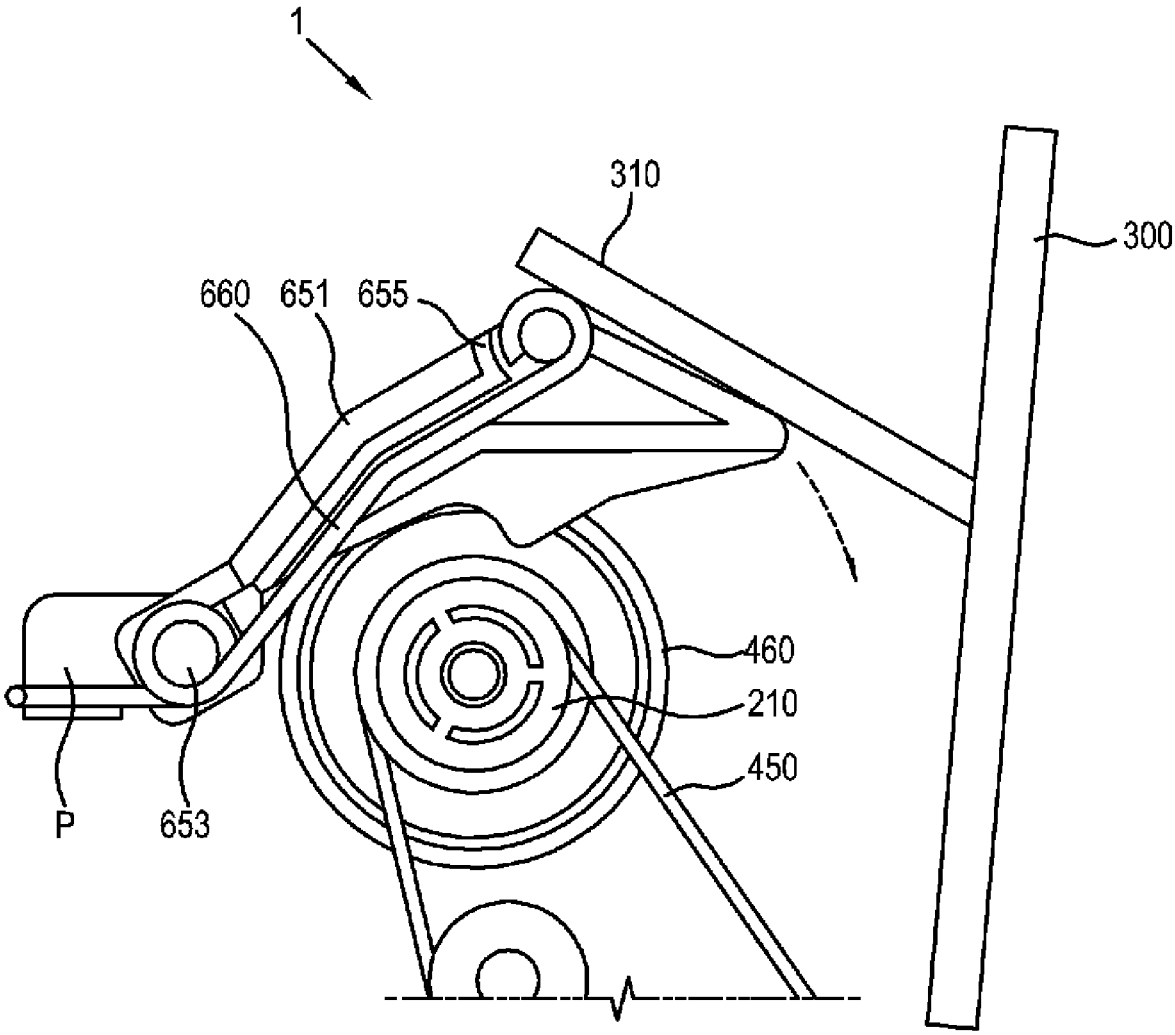
FIGS. 9A and 9B are schematic views illustrating the coupling apparatus according to the second example embodiment of the present invention at coupling and decoupling positions, respectively.

First, if the external force 310 is not applied to the coupling lever 650 as shown in FIG. 9A, the second guide part 625 of the coupling knob 620 and the third movement changing part 613 of the coupling link 610 are disposed alternately with each other as shown in FIG. 11A. At this time, due to difference in size between an outer diameter of the coupling link 610 and an inner diameter of the knob main body 621, the coupling link 610 cannot move toward the coupling knob 620. Accordingly, the first counter part 211 and the coupling part 635 are not connected to each other, and thus the rotational force is not transmitted from the second counter part 410 to the first counter part 111.

Figure 9B:
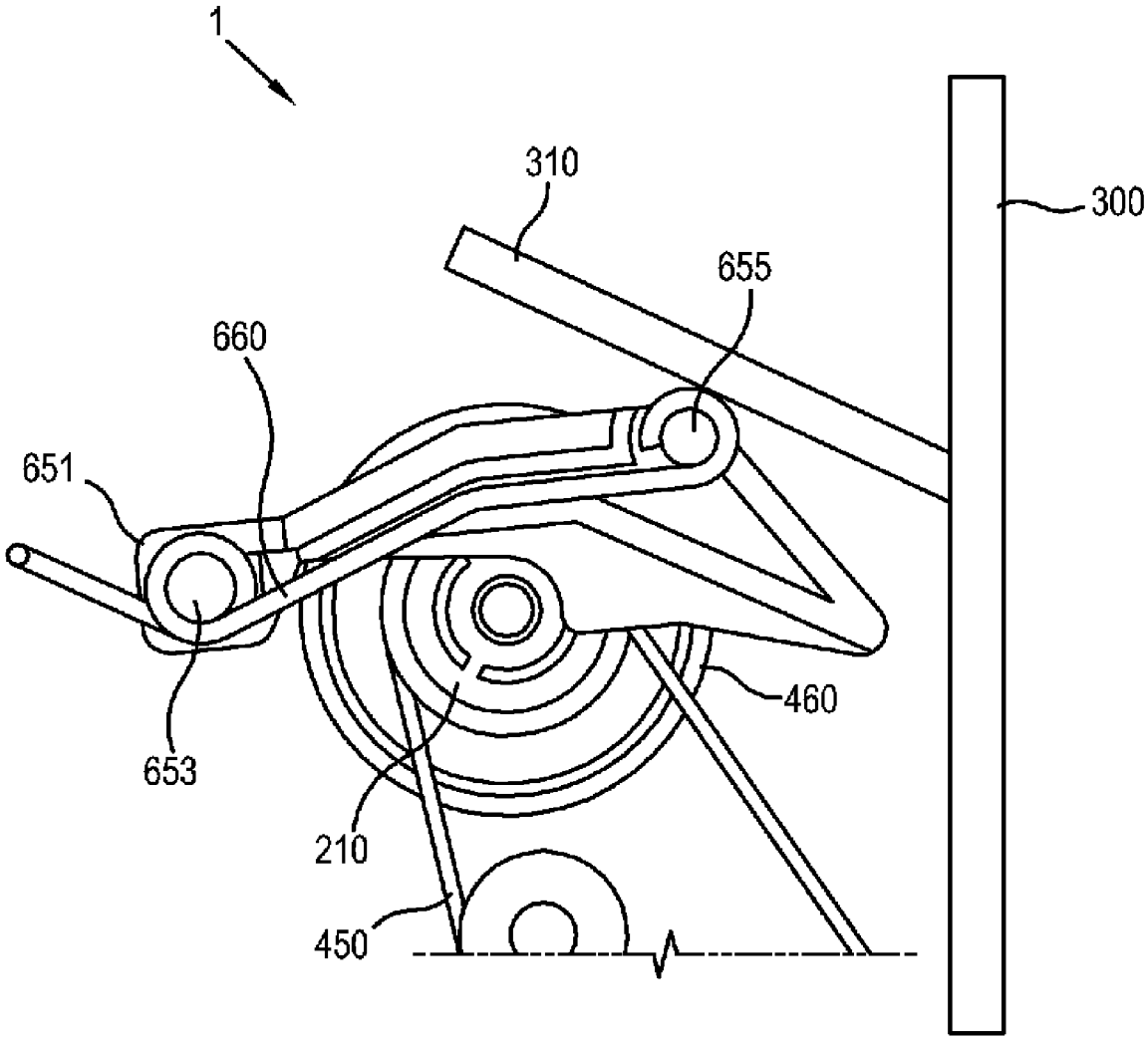
Figure 10:
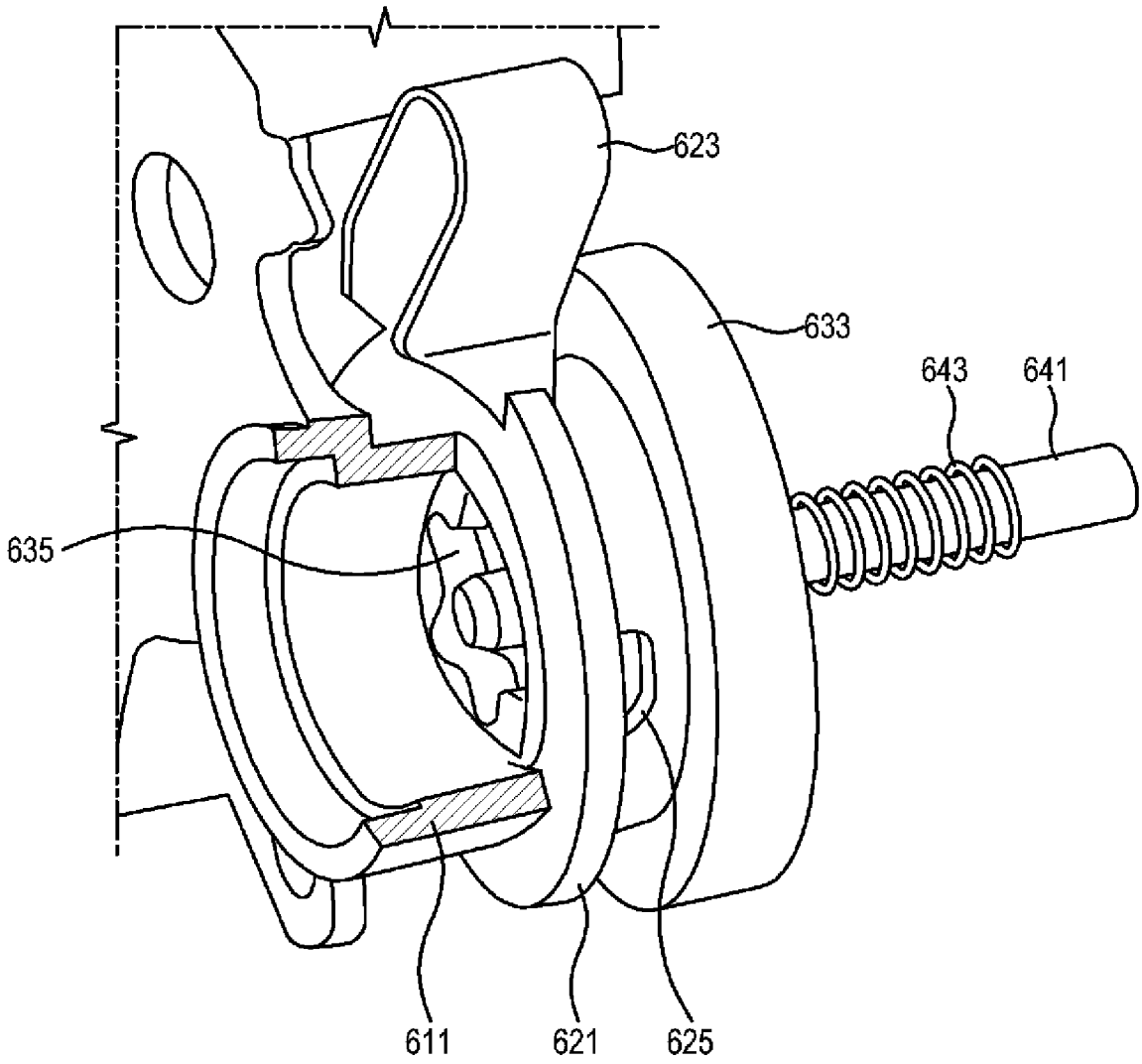
FIG. 10 is a schematic perspective view of a coupling member according to the second example embodiment of the present invention when coupling is released.

On the other hand, if the external force 310 is applied as shown in FIG. 9B, the coupling lever 650 rotates along with the coupling knob 620. At this time, the second guide part 625 of the knob main body 621 is rotated to fit to the third movement changing part 613, so that the knob main body 621 can move in the axial direction. Accordingly, the coupling member 630 is coupled to the first counterpart 211 and transmits the rotational force from the second counterpart 410 to the first counterpart 211 as the gear part 633 rotates.

Meanwhile, the elastic member 660 elastically biases the coupling lever 650 in such a manner that the first counterpart 211 and the coupling part 635 are decoupled from each other. Accordingly, at a moment when the coupling lever 650 is released from pressure, the elastic member 660 elastically biases the coupling lever 650 to an initial position, so that the coupling knob 620 and the coupling member 630 directly move to the decoupling position.

According to the second example embodiment of the present invention, the coupling apparatus additionally includes the coupling lever and the elastic member and is thus more quickly changed from the coupling position to the decoupling position as compared with that of the first example embodiment. Further, in the second example embodiment, the total number of components is reduced as compared with that of the first example embodiment, so that an assembling process can be simplified.

In the example embodiments described above, the coupling apparatus is described as transmitting power to the belt driving unit 460 that drives the transfer belt 451 forming the transfer unit 450, but aspects of the present invention are not limited thereto. The belt driving unit according to aspects of the present invention is not limited to the transfer unit, and may be used for other image forming apparatuses, such as a monochrome printer, a facsimile machine, a digital photocopier, and multifunction devices. In addition, the belt driving unit may be used for a printable medium feeding unit that feeds an outputted printable medium, a photosensitive belt unit that forms an electrostatic latent image to form a toner image, and a mid-transfer unit that transfers and maintains the toner image. Also, aspects of the present invention may be used in a belt feeding unit such as a belt conveyor.

As described above, the coupling apparatus according to aspects of the present invention is provided to be automatically restored to a decoupling position by an elastic member when the external force is released from the coupling knob, to thereby be prevented from being coupled by opening of the cover or an external impact. Accordingly, the image forming apparatus employing the coupling apparatus can be prevented from being damaged when the cabinet is opened or closed by malfunction of the coupling apparatus.

Rotational components among the components forming the coupling apparatus according to aspects of the present invention are disposed to be rotatably driven centering on the shaft, thereby obtaining a compact configuration to enhance durability, and reducing an installing space. Since the rotational center of the coupling apparatus is disposed on a rotational axis of the driving roller driving the transfer unit in the image forming apparatus employing the coupling apparatus, coupling components can be disposed in a small space. The compact configuration of the coupling apparatus improves intensity, thereby enhancing durability.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, aspects of the present invention may include a method of coupling or decoupling a component of an image forming apparatus from a driving unit when a cover of the image forming apparatus is closed or opened so as to reduce damage to components of the apparatus. The method may include applying a force to a coupling knob attached to a coupling apparatus that selectively couples a driving unit to a component of an image forming apparatus while the coupling apparatus is in a decoupled state wherein the component of the image forming apparatus is not coupled to the driving unit; automatically rotating the coupling knob in response to the application of the force; converting the rotation of the coupling knob into an axial movement of a shaft; switching the state of the coupling apparatus from the decoupled state to a coupled state in which the coupling apparatus couples the component of the image forming apparatus to the driving unit, in response to the axial movement of the shaft; maintaining the coupling apparatus in the coupling state while the force is applied to the coupling knob; and automatically switching the state of the coupling apparatus from the coupled state to the decoupled state when the force is no longer applied to the coupling knob. Accordingly, it is intended, therefore, that the present invention not be limited to the various example embodiments disclosed, but that the present invention includes all embodiments falling within the scope of the appended claims.

What is claimed is:

1. An image forming apparatus comprising:

a main body unit which has an image forming unit;

a door unit which couples with the main body unit to open and close the main body unit, and has a projection at one side thereof;

a mid-transfer unit which couples with the door unit;

a coupling knob which is provided in the main body unit and rotates in cooperation with pressure of the projection when the door unit is closed; and a coupling apparatus which is provided in the main body and transmits a driving force from the main body unit to the mid-transfer unit in cooperation with the rotation of the coupling knob.

2. The image forming apparatus according to claim 1, wherein the coupling apparatus comprises:

a frame; and a shaft installed in the frame and arranged to rotate and move in an axial direction, wherein the shaft interlocks with the rotation of the coupling knob and moves to the mid-transfer unit in the axial direction.

3. The image forming apparatus according to claim 2, wherein the coupling apparatus comprises:

a coupling link coupled to the frame movably in the axial direction of the shaft and arranged to move in the axial direction in cooperation with the rotation of the coupling knob; and a coupling unit coupled to the shaft, and arranged to rotate along with the shaft and to move between a coupling position and a decoupling position in the axial direction of the shaft according to the movement of the coupling link.

4. The image forming apparatus according to claim 1, further comprising an elastic member to elastically bias the coupling unit to the decoupling position.

5. The image forming apparatus according to claim 4, wherein the coupling unit comprises:

a coupling member coupled to the shaft, rotatably installed independently of the coupling link, and coupled to the mid-transfer unit; and a relay member coupled to the shaft to transmit a driving force from a driving source to the shaft.

6. The image forming apparatus according to claim 5, wherein the elastic member is provided between the relay member and the coupling knob.

7. The image forming apparatus according to claim 6, wherein the shaft comprises a first stopping part in which the coupling member is installed, the mid-transfer unit comprises a mid-transfer belt and a driving roller to drive the mid-transfer belt, and the coupling member comprises a first hook member hooked to the first stopping part and a spline formed on an inside circumference of the coupling member and engaged with a rotational shaft of the driving roller.

8. The image forming apparatus according to claim 7, wherein the frame comprises:

a frame main body having an installing hole in which the shaft, the coupling knob, and the coupling link are installed;

a first installing part formed in the frame main body, and in which the coupling knob is rotatably installed; and a first guide part formed in the frame main body to guide the coupling link to move in the axial direction.

9. The image forming apparatus according to claim 8, wherein the coupling knob comprises:

a knob main body having a first through hole through which the shaft is installed;

a first movement changing part formed on one side of the knob main body to change the rotational movement of the knob main body into the axial direction movement;

a second installing part formed in a position of the knob main body so as to face the first installing part; and a knob member formed in the knob main body to rotate the knob main body.

10. The image forming apparatus according to claim 9, wherein:

the first installing part is provided as a guide hole formed around the installing part to guide the rotation of the coupling knob; and the second installing part is provided as a coupling protrusion projected in the knob main body and rotatably installed in the guide hole, to regulate the rotation of the knob main body.

11. The image forming apparatus according to claim 10, wherein the coupling link comprises:

a link main body having an accommodating part that accommodates the coupling member, and a second through hole through which the shaft is installed;

a second movement changing part formed on one side of the link main body to face the first movement changing part to change the rotation of the first movement changing part into the axial direction movement; and a second guide part formed in a position of the link main body corresponding to the first guide part to guide the link main body to move in the axial direction.

12. The image forming apparatus according to claim 11, wherein:

the first guide part is provided as a guide projection protruding from one side of the frame main body, and the second guide part is provided as a guide groove in the link main body in a shape corresponding to a shape of the guide projection.

13. The image forming apparatus according to claim 4, further comprising a coupling lever coupled to the coupling knob and arranged to rotate along with the coupling knob, wherein the elastic member is coupled to the coupling lever to elastically bias the coupling lever in a direction of moving the coupling knob to the decoupling position when the coupling knob is released from the pressure of the projection.

14. The image forming apparatus according to claim 13, wherein the coupling link comprises:

a link main body having a through hole through which the shaft is installed; and a third movement changing part protruding from an external circumference of the link main body to change rotation of the coupling knob into an axial direction movement.

15. The image forming apparatus according to claim 14, wherein the coupling knob comprises:

a knob main body arranged to move in the axial direction of the shaft;

a knob member extended from the knob main body outwardly and coupled to the coupling lever; and a second guide part that formed on one side of the knob main body and accommodating and releasing the third movement changing part in cooperation with rotation of the knob main body to guide the knob main body to move in the axial direction.

16. The image forming apparatus according to claim 14, wherein the coupling member comprises:

a gear part coupled to the shaft and transmitting a rotational force from a driving source to the shaft; and a coupling unit coupled to the mid-transfer unit at the coupling position and transmitting the rotational force from the gear part to the mid-transfer unit.

17. A coupling apparatus, comprising:

a frame;

a shaft installed in the frame and arranged to rotate in an axial direction;

a coupling knob rotatably coupled to the frame and arranged to rotate coaxially with and independently of the shaft by an external force;

a coupling link coupled to the frame movably in the axial direction of the shaft, and arranged to move in the axial direction according to the rotation of the coupling knob;

a coupling unit coupled to the shaft arranged to rotate along with the shaft and to move between a coupling position and a decoupling position in the axial direction of the shaft according to the movement of the coupling link, to couple a component to a driving unit; and an elastic member installed around the shaft to elastically bias the coupling unit to the decoupling position.

* * * * *

UNITED STATES PATENT AND TRADEMARK OFFICE

CERTIFICATE OF CORRECTION

PATENT NO. : 7,903,997 B2
APPLICATION NO. : 11/947313
DATED : March 8, 2011
INVENTOR(S) : Woo-chul Jung et al.

It is certified that error appears in the above-identified patent and that said Letters Patent is hereby corrected as shown below:

Title Page item (75) Column 1 (Inventors), Line 1, Delete "(Youngin-si, KR);" and insert -- (Yongin-si, KR); --, therefor.

Column 14, Line 21, In Claim 7, after "wherein" insert -- : --.

Signed and Sealed this
Sixth Day of March, 2012

David J. Kappos

David J. Kappos
*Director of the United States Patent and Trademark Office*